US010297099B2

(12) United States Patent
Iizuka et al.

(10) Patent No.: US 10,297,099 B2
(45) Date of Patent: May 21, 2019

(54) MEDIA TRANSACTION DEVICE

(71) Applicant: Oki Electric Industry Co., Ltd., Tokyo (JP)

(72) Inventors: Yuta Iizuka, Tokyo (JP); Atsushi Takada, Tokyo (JP); Naoto Kondou, Tokyo (JP); Yuuji Oota, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 54 days.

(21) Appl. No.: 15/329,245

(22) PCT Filed: Jun. 2, 2015

(86) PCT No.: PCT/JP2015/065937

§ 371 (c)(1),
(2) Date: Jan. 25, 2017

(87) PCT Pub. No.: WO2016/031333

PCT Pub. Date: Mar. 3, 2016

(65) Prior Publication Data

US 2017/0221293 A1 Aug. 3, 2017

(30) Foreign Application Priority Data

Aug. 25, 2014 (JP) ..... 2014-170529

(51) Int. Cl.
*G07D 11/14* (2019.01)
*G07D 11/22* (2019.01)
(Continued)

(52) U.S. Cl.
CPC ..... *G07D 11/14* (2019.01); *G07D 7/003* (2017.05); *G07D 7/12* (2013.01); *G07D 11/22* (2019.01); *G07D 11/40* (2019.01)

(58) Field of Classification Search
CPC ..... G07D 7/00; G07D 7/15; G07D 2207/00; G07D 2211/00; G07D 11/00;
(Continued)

(56) References Cited

U.S. PATENT DOCUMENTS 5,259,576 A * 11/1993 Howard ..... B64C 1/1438 244/129.4
2008/0035446 A1* 2/2008 Yoshida ..... G07D 11/0018 194/318
(Continued)

FOREIGN PATENT DOCUMENTS

| | | | |
|---|---|---|---|
| CN | 1811833 | A | 8/2006 |
| JP | 2003-067808 | A | 3/2003 |
| JP | 2012-074068 | A | 4/2012 |
| JP | 2014-029736 | A | 2/2014 |
| JP | 2014-086007 | A | 5/2014 |

*Primary Examiner* — Jeffrey A Shapiro
(74) *Attorney, Agent, or Firm* — Rabin & Berdo, P.C.

(57) ABSTRACT

A media transaction device comprising: a device housing having a front panel; a media processor provided at an interior of the device housing; a media accommodating unit provided at an interior of the media processor; and a foreign matter sensor detecting absence/presence of a foreign object at the media accommodating unit. The front panel includes a first port for inserting and dispensing the media, and a first shutter opening and closing the first port. The media processor includes a second port disposed to face the first port, and a second shutter for opening and closing the second port. The media are inserted into and dispensed from the second port such that the media are inserted into and dispensed from the first port, and opening and closing of the first shutter and the second shutter are controlled based on detection results by the foreign matter sensor.

14 Claims, 15 Drawing Sheets

(51) Int. Cl.
*G07D 7/12* (2016.01)
*G07D 7/00* (2016.01)
*G07D 11/40* (2019.01)

(58) Field of Classification Search
CPC ..... G07D 11/0003; G07D 11/0006; G07D 11/0009; G07D 11/0012; G07D 11/0018; G07D 11/0021; G07D 11/0024; G07D 11/045; G07D 11/0048; G07D 11/0051; G07D 11/0054; G07D 11/0057; G07D 11/006; G07D 11/0063; G07D 11/0066; G07D 11/0069; G07D 11/0072; G07D 11/0075; G07D 11/0084; G07D 7/06; G07D 7/12; G07F 1/00; G07F 19/00; G07F 19/20; G07F 19/201; G07F 19/205; G07F 19/207; G07F 19/209; G07F 7/04; G06Q 20/1085; B65H 2701/1912; B65H 2301/4314; B07C 5/34; F16H 19/04
USPC ..... 194/206, 207; 209/534; 235/379; 232/44
See application file for complete search history.

(56) References Cited

U.S. PATENT DOCUMENTS

2009/0195993 A1* 8/2009 Herd ..... G06Q 20/1085 361/724
2011/0068169 A1* 3/2011 Ross ..... G06K 7/0008 235/379
2012/0210916 A1* 8/2012 Takashima ..... G07F 19/205 109/64
2013/0015035 A1* 1/2013 Tanaka ..... G07D 11/0018 194/206
2013/0299568 A1* 11/2013 Kimoto ..... G07D 11/0018 232/7
2014/0090950 A1* 4/2014 Johnson ..... G07D 11/0051 194/344
2015/0279144 A1* 10/2015 Peters ..... G07D 11/0018 194/344
2015/0317858 A1* 11/2015 Suetaka ..... G07D 13/00 194/351
2017/0337764 A1* 11/2017 Yokawa ..... G07D 11/0018

* cited by examiner

MEDIA TRANSACTION DEVICE

TECHNICAL FIELD

The present invention relates to a media transaction device, and is suitable for application to, for example, an automatic cash transaction device (an ATM: Automatic Teller Machine), into which media such as bills and the like are inserted and that carries out desired transactions, and the like.

BACKGROUND ART

Conventionally, in automatic cash transaction devices and the like that are used in financial institutions and stores and the like, for example, a customer is asked to insert cash such as bills and coins or the like, or cash is dispensed to a customer, in accordance with the contents of the transaction with the customer. As an automatic cash transaction device, for example, there are those having a money insert/dispensing portion that carries out transfer of bills to and from the customer, a discriminating section that discriminates the denomination and the authenticity of an inserted bill and identifies the serial number of the bill, a temporary holding portion that temporarily holds inserted bills, a conveying section that conveys bills, and recycling depositories that store bills per denomination.

Among such automatic cash transaction devices, there are those that have, at the money insert/dispensing portion, two shutters that are a device shutter that opens and closes a device money insert/dispensing port formed at a device housing that forms the automatic cash transaction device, and a processor shutter that opens and closes a processor money insert/dispensing port formed at a processor housing that forms a bill processor disposed at the device housing interior (see, for example, Japanese Patent Application Laid-Open (JP-A) No. 2003-67808).

Among such automatic cash transaction devices, there are those that have two different foreign object sensors that are a device foreign object sensor provided further toward the inner side of the device housing than the device shutter and sensing a foreign object such as a finger of the user or the like, and a processor foreign object sensor provided further toward the inner side of the processor housing than the processor shutter and sensing a foreign object such as a finger of the user or the like.

SUMMARY OF INVENTION

Technical Problem

In such automatic cash transaction devices, further simplification of the structure of the money insert/dispensing portion is desired.

The present invention was proposed in consideration of the above-described points, and seeks to propose a media transaction device whose structure can be simplified.

Solution to Problem

In order to solve this problem, a media transaction device of an aspect of the present invention includes a device housing, a media processor, a media accommodating portion, a customer interface control section, a processor control section, and a foreign object sensor. The device housing is provided with a customer interface portion that receives operations relating to paper-sheet-like media, a device insert/dispensing port (a first insert/dispensing port) into and from which the media are inserted and dispensed, and a device shutter (a first shutter) that opens and closes the device insert/dispensing port. The media processor is provided at an interior of the device housing and carries out processings of the media, and the media processor has a processor insert/dispensing port (a second insert/dispensing port) and a processor shutter (a second shutter), the processor insert/dispensing port is disposed so as to face the device insert/dispensing port and into and from which the media are inserted and dispensed, and the processor shutter opens and closes the processor insert/dispensing port. The media accommodating portion is provided at an interior of the media processor and is opened or closed-off with respect to an exterior via the device insert/dispensing port and the processor insert/dispensing port by opening/closing of the device shutter and the processor shutter. The opening and closing of the device shutter and the processor shutter are controlled based on results of sensing of the foreign object sensor.

In this media transaction device, results of sensing of the foreign object sensor are acquired and the opening and closing of the device shutter and the processor shutter may be controlled by either one of the customer interface control section (a first control unit) or the processor control section (a second control unit), without providing a foreign object sensor at each of the device shutter and the processor shutter.

Advantageous Effects of Invention

Since results of sensing of a foreign object sensor are acquired and a device shutter and a processor shutter are controlled by either one of a customer interface control section or a processor control section, without providing a foreign object sensor at each of the device shutter and the processor shutter, in a media transaction device the structure are relatively simplified.

DESCRIPTION OF EMBODIMENTS

Examples for embodying the invention (hereinafter called embodiments) are described hereinafter by using the drawings.

1. First Embodiment

[1-1. Structure of Automatic Cash Transaction Device]

Figure 1:
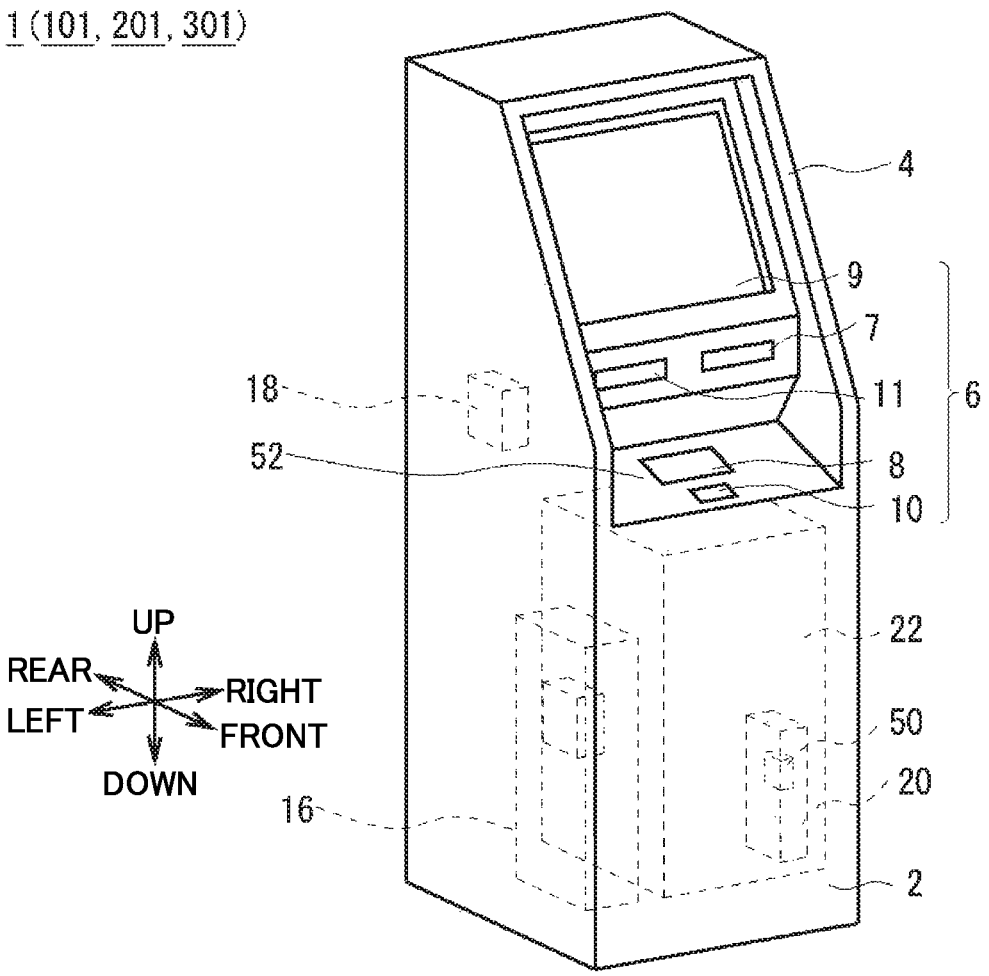
FIG. 1 is a perspective view showing the structure of an automatic cash transaction device.
Figure 3:
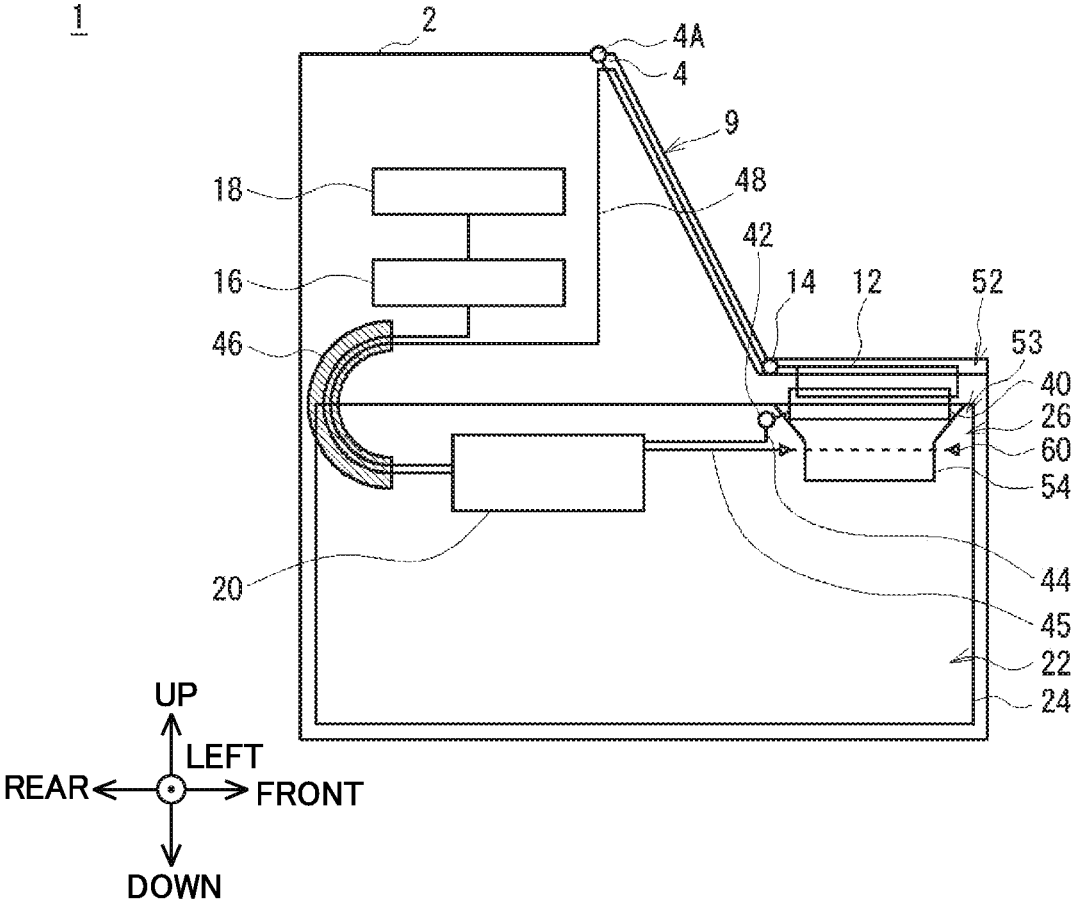
FIG. 3 is a left side view showing the structure of the automatic cash transaction device in a front panel closed state in accordance with a first embodiment.

At the exterior shown in FIG. 1, an automatic cash transaction device 1 is structured so as to be centered around a device housing 2 that is shaped as a box, and is set in a financial institution or the like for example, and carries out transactions relating to cash, such as deposit transactions and withdrawal transactions and the like, with customers. At the device housing 2, a front panel 4, that is substantially backward L-shaped as seen in side view and that has a predetermined thickness as shown in FIG. 3, is provided at a place that is at an upper portion of a front side of the device housing 2 and at which insertion of bills and operation of a touch panel and the like are easy in a state in which a customer is facing the device housing 2.

Figure 4:
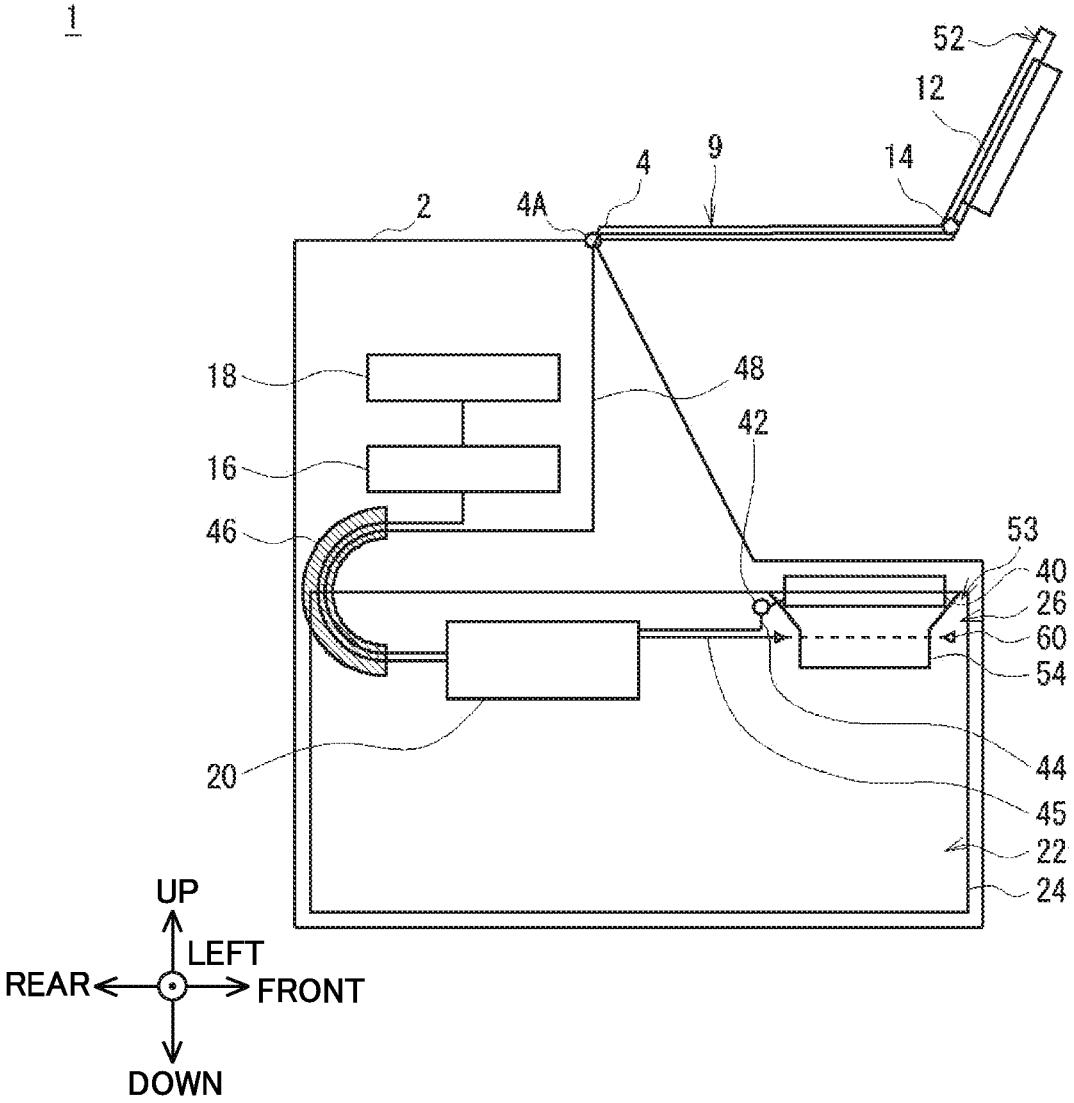
FIG. 4 is a left side view showing the structure of the automatic cash transaction device in a front panel opened state in accordance with the first embodiment.

The front panel 4 is structured so as to be opened and closed by being rotated around a front panel supporting point 4A (see FIG. 3) that is provided at an upper end portion of the front panel 4 and that serves as a customer interface portion supporting point. The front panel 4 rotates, around the front panel supporting point 4A and with respect to the device housing 2, such that a device shutter 12 approaches and moves away from a processor shutter 40 that is described later. Namely, at times of transaction operations relating to cash are carried out with customers, the device housing 2 is set in a front panel closed state as shown in FIG. 3, and protects the various types of mechanisms at the interior. On the other hand, at times when a clerk or a maintenance worker or the like of the financial institution carries out maintenance work on the various types of mechanisms at the interior, or the like, the device housing 2 is, as needed, set in a front panel opened state as shown in FIG. 4, and work on respective portions at the interior can be carried out easily.

A customer interface portion 6 is provided at the front panel 4. A card insert/dispensing port 7, a device money insert/dispensing port 8, an operation/display portion 9, a ten key 10, and a receipt issuing port 11 are provided at the customer interface portion 6. The customer interface portion 6 directly exchanges cash and passbooks and the like with customers, and carries out the notifying of information relating to transactions and the receiving of operation instructions. The card insert/dispensing port 7 is a portion into which and from various types of cards such as cash cards and the like are inserted and discharged. A card processing portion (not shown), that carries out reading of the account number and the like that are magnetically recorded on various types of cards, is provided at a rear side of the card insert/dispensing port 7. The device money insert/dispensing port 8 is an opening through which bills pass when the bills are inserted by a customer and at the time when bills to be dispensed to a customer are discharged. Further, the device money insert/dispensing port 8 is opened or closed by driving of the device shutter 12 (see FIG. 3) that is provided at the front panel 4.

At the operation/display portion 9, an LCD (Liquid Crystal Display) that displays operation screens at times of transactions, and a touch panel, at which the selection of various types of transactions, and passcodes, transaction amounts and the like are inputted, are made integral. The ten key 10 is physical keys that receive input of the numbers "0" through "9", and the like, and is used at the time of the operation of inputting the passcode or the transaction amount or the like. The receipt issuing port 11 is a portion that, at the time when the transaction processing ends, issues a receipt on which the transaction contents and the like are printed. A receipt processing section (not shown) that prints the transaction contents and the like on the receipt, is provided at a rear side of the receipt issuing port 11.

As shown in FIG. 3, a device shutter motor 14 (a first shutter motor 14) that drives the device shutter 12 is provided at the rear of the device shutter 12 at the front panel 4. Further, an unillustrated device shutter position detecting sensor is provided in a vicinity of the device shutter 12. This device shutter position detecting sensor detects the position of the device shutter 12, and informs a processor control section 20, that is described later, of the results of detection.

An integrated control section 16, that is connected by wiring cables to a customer interface control section 18 and the processor control section 20, that are described later, is provided so as to integratedly control the entire automatic cash transaction device 1 within the device housing 2. Further, a bill processor 22, that is provided at a lower side of the device housing 2 interior and that carries out various types of processing relating to bills, and the like is provided within the device housing 2. The integrated control section 16 is structured so as to be centered around an unillustrated CPU (Central Processing Unit), and, by reading-out predetermined programs from a storage section (not illustrated) that is formed by a ROM (Read Only Memory), a RAM (Random Access Memory), a hard disk drive, a flash memory or the like, and executing the programs, the integrated control section 16 controls the respective sections and carries out various types of processings such as deposit transactions and withdrawal transactions and the like. The customer interface control section 18 is mounted to a predetermined customer interface control substrate, and is disposed at an outer side of the bill processor 22 at the device housing 2 interior, and controls the customer interface section 6.

Hereinafter, description is given by defining, of the automatic cash transaction device 1, a side that the user faces as a front side, an opposite thereof as a rear side, and left and right as seen from a user facing the front side as a left side and a right side respectively, and further, an upper side and a lower side.

[1-2. Internal Structure of Bill Processor]

Figure 2:
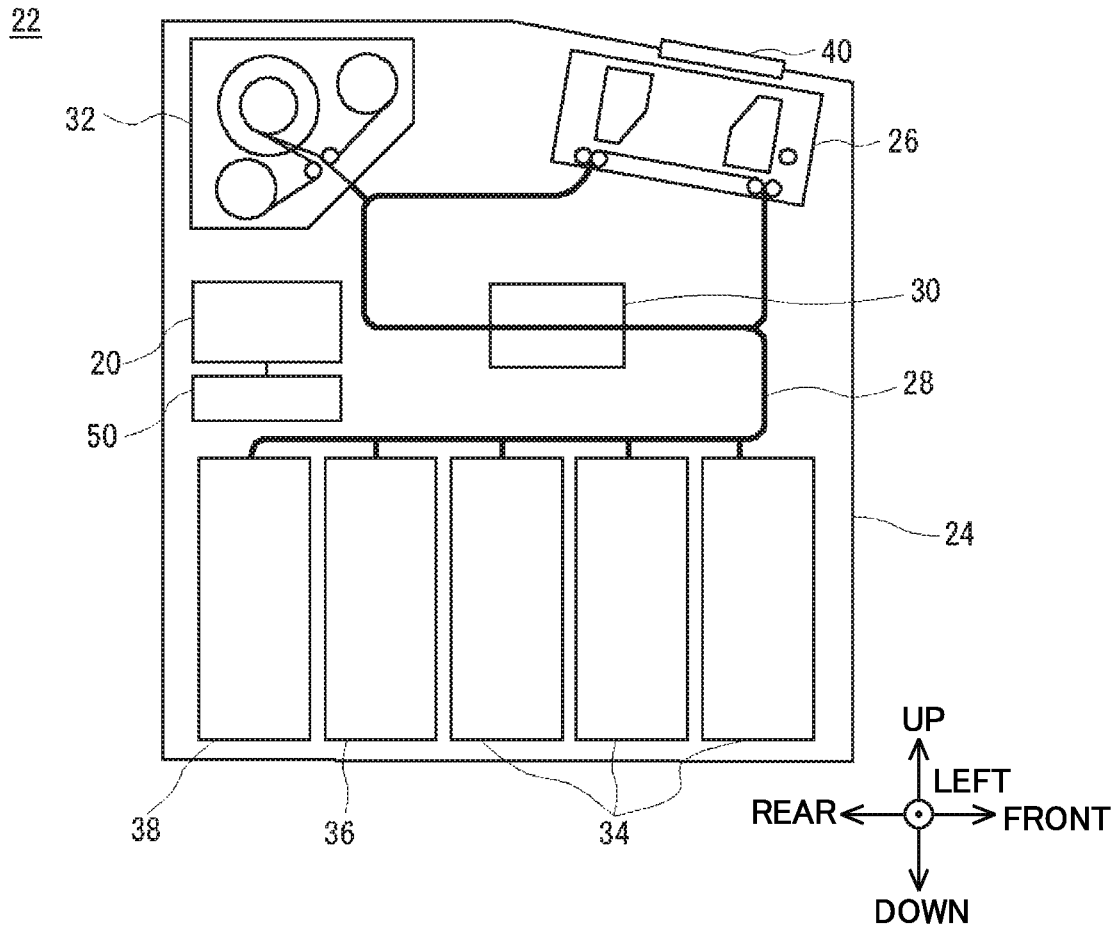
FIG. 2 is a left side view showing the structure of a bill processor.

As shown in FIG. 2, the bill processor 22 is structured so as to have a processor housing 24 that is box-shaped as a main part. The processor control section 20, that is mounted to a predetermined customer interface control section substrate and that controls the respective sections at the processor housing 24 interior (a money insert/dispensing portion 26, a conveying section 28, a discriminating section 30, a temporary holding portion 32, recycling depositories 34, a reject depository 36 and a left-behind depository 38), is provided at the interior of the processor housing 24.

The processor control section 20 is structured so as to be centered around an unillustrated CPU, and, by reading-out predetermined programs from a storage section 50 that is formed by a ROM, a RAM, a hard disk drive, a flash memory or the like, and executing the programs, controls the respective sections and carries out various types of processings such as deposit transactions and withdrawal transactions and the like.

The processor housing 24 is structured such that, in a state in which an unillustrated front door that is provided at the front side of the device housing 2 is opened, a maintenance worker can, for example, slide the processor housing 24 toward the front side and take the processor housing 24 out to the exterior of the device housing 2. As shown in FIG. 3, the processor shutter 40 is provided at the processor housing 24, and a processor shutter motor 42 (a second shutter motor 40) that drives the processor shutter 40 is provided at the rear of the processor shutter 40. Further, an unillustrated processor shutter position detecting sensor is provided in a vicinity of the processor shutter 40. This processor shutter position detecting sensor detects the position of the processor shutter 40, and notifies the processor control section 20 of the results of detection.

At the processor control section 20, a wiring cable 44, that serves as a money insert/dispensing machine shutter motor wire (a second wire), is connected to the processor shutter motor 42 and to the processor shutter position detecting sensor (not shown), and a wiring cable 45, that serves as a foreign object sensor wire (a third wire), is connected to a hand sensor 60 that senses a finger of the user, or the like. The processor control section 20 acquires the results of detection of the processor shutter 40 from the processor shutter position detecting sensor, and, by driving the processor shutter motor 42, opens and closes the processor shutter 40. Further, from the processor control section 20, a wiring cable 48, that serves as a device wire (a first wire), is routed from the interior of the processor housing 24 to the device housing 2 interior via a plastic chain 46. The wiring cable 48 passes-by a vicinity of the front panel supporting point 4A and the side of the operation/display portion 9 without going through the integrated control section 16 and the customer interface control section 18, and the wiring cable 48 is connected to the processor shutter motor 42 and to the processor shutter position detecting sensor (not shown). The processor controlling section 20 acquires the results of detection of the device shutter 12 from the device shutter position detecting sensor, and opens and closes the device shutter 12 by driving the device shutter motor 14.

At the automatic cash transaction device 1, the wiring cable 48 is provided so as to pass-by a vicinity of the front panel supporting point 4A whose position hardly changes at all between either of the front panel closed state and the front panel opened state. Therefore, at the time of transitioning from the front panel closed state to the front panel opened state, the wiring cable 48 can be prevented from being greatly exposed to the exterior of the device housing 2 and from being applied a large load.

The money insert/dispensing portion 26, the discriminating section 30 that judges the denomination and the authenticity of bills, the temporarily holding portion 32 that temporarily holds inserted bills, and the like are provided at the upper side at the interior of the bill processor 22.

The money insert/dispensing portion 26 separates one-by-one bills that have been inserted-in from a customer, and sends them out to the conveying section 28. Further, at the money insert/dispensing portion 26, an unillustrated bill sensor, that detects whether or not a bill that is to be sent-out to the conveying section 28 exists, is provided at the interior of the money insert/dispensing portion 26.

The conveying section 28 conveys rectangular shaped bills along short side directions thereof along the conveying path that is shown by the thick lines in the drawings, by unillustrated rollers and belts and the like. The conveying section 28 conveys the bills so as to insert the bills through the discriminating section 30 in the front-rear direction, and connects the rear side of the discriminating section 30 with the temporary holding portion 32 and the money insert/dispensing portion 26, respectively. Further, the conveying section 28 connects the front side of the discriminating section 30 with the money insert/dispensing portion 26, the recycling depositories 34, the reject depository 36 and the left-behind depository 38. Selectors (not shown) are provided at the forking points of the conveying section 28, and the conveying destination of a bill is switched by rotating the selectors on the basis of control of the processor control section 20.

While conveying a bill at the interior thereof, the discriminating section 30, by using optical elements or magnetic detection elements or like, discriminates the denomination and authenticity of a bill, and the extent of damage thereof, and the like (the damaged/undamaged state), and notifies the processor control section 20 of the results of this discrimination. In accordance therewith, the processor control section 20 determines the conveying destination of the bill on the basis of the acquired results of discrimination and results of identification.

The temporary holding portion 32 temporarily holds bills that a customer has inserted into the money insert/dispensing portion 26 at the time of a deposit, and, temporarily holds bills, that have been discriminated by the discriminating section 30 as being depositable, until the deposit is settled. On the other hand, reject bills that have been discriminated as being unable to be deposited are discharged to the money insert/dispensing portion 26. Further, at the time of dispensing, the temporary holding portion 32 temporarily holds dispensing reject bills, that have been identified by the discriminating section 30 as being unable to be dispensed, until dispensable bills are dispensed, and thereafter, discharges these dispensing reject bills to the reject depository 36.

Further, the recycling depositories 34 for each denomination, and the reject depository 36 that stores bills that have been discriminated as being bills that are damaged (so-called damaged bills) at the discriminating section 30, and bills that have been judged to be counterfeit bills, and bills of denominations that cannot be circulated such as 5000-yen bills and 2000-yen bills and the like, and the left-behind depository 38 that recovers and stores bills that a customer has left-behind at the money insert/dispensing portion 26 at the time of a transaction, are provided at the lower side at the interior of the bill processor 22. By an accommodating/discharging mechanism, the recycling depositories 34 take-in bills that have been conveyed-in from the conveying section 28, and accommodate them, and discharge accommodated bills and supply them to the conveying section 28.

At the the automatic cash transaction device 1 of the above described structure, the integrated control section 16 and the processor control section 20 control the respective sections on the basis of the results of discrimination and the results of identification of bills by the discriminating section 30, and carries out deposit processing and dispensing processing and the like of bills.

Namely, at the time of a deposit transaction, when a deposit transaction is selected by the customer via the operation/display portion 9 and, further, bills are inserted in the money insert/dispensing portion 26, the automatic cash transaction device 1 conveys the inserted bills one-by-one from the money insert/dispensing portion 26 to the discriminating section 30. Here, the automatic cash transaction device 1 conveys depositable bills, that have been judged as being depositable on the basis of the results of discrimination and the results of identification of the discriminating section 30, to the temporary holding portion 32 and temporarily accommodates them therein. On the other hand, the automatic cash transaction device 1 returns deposit reject bills, that have been judged as being unsuitable for deposit, to the money insert/dispensing portion 26, and, by opening the device shutter 12 and the processor shutter 40, returns the deposit reject bills to the customer. Thereafter, when the deposit amount is settled by the customer, the automatic cash transaction device 1 conveys the bills, that are accommodated in the temporarily holding portion 32, to the discriminating section 30, and acquires results of discrimination and results of identification of the serial numbers. Here, the automatic cash transaction device 1 conveys bills, that are judged as being able to be accommodated on the basis of the results of discrimination and the results of identification of the discriminating section 30, to the respective recycling depositories 34 in accordance with the denominations thereof, and stores them therein. On the other hand, the automatic cash transaction device 1 conveys bills, that are judged as being unsuitable for accommodation, to the reject depository 36.

On the other hand, at the time of a dispensing transaction, when a dispensing transaction is selected by the customer via the operation/display portion 9 and the amount to be dispensed is inputted, the automatic cash transaction device 1 identifies the number of bills per denomination that are needed in accordance with the requested amount, and sends-out the bills from the respective recycling depositories 34 in accordance with the number of bills per denomination, and conveys the bills to the discriminating section 30 and obtains results of discrimination and results of identification of the serial numbers. Here, the automatic cash transaction device 1 conveys to the money insert/dispensing portion 26 the dispensable bills that have been judged as being able to be dispensed on the basis of the results of discrimination and the result of identification of the discriminating section 30. On the other hand, the automatic cash transaction device 1 conveys dispensing reject bills, that have been judged as not being suited to dispensing, to the temporary holding portion 32 and temporarily accommodates them therein. Then, when bills of the requested monetary amount are stacked in the money insert/dispensing portion 26, the automatic cash transaction device 1 opens the device shutter 12 and the processor shutter 40. Due thereto, taking of the bills that are stacked within the money insert/dispensing portion 26 is possible, and the customer takes these bills. Thereafter, the automatic cash transaction device 1 conveys the dispensing reject bills, that are accommodated in the temporary holding portion 32, to the reject depository 36 and stores them therein.

[1-3. Structure of Money Insert/Dispensing Portion)

Figure 5:
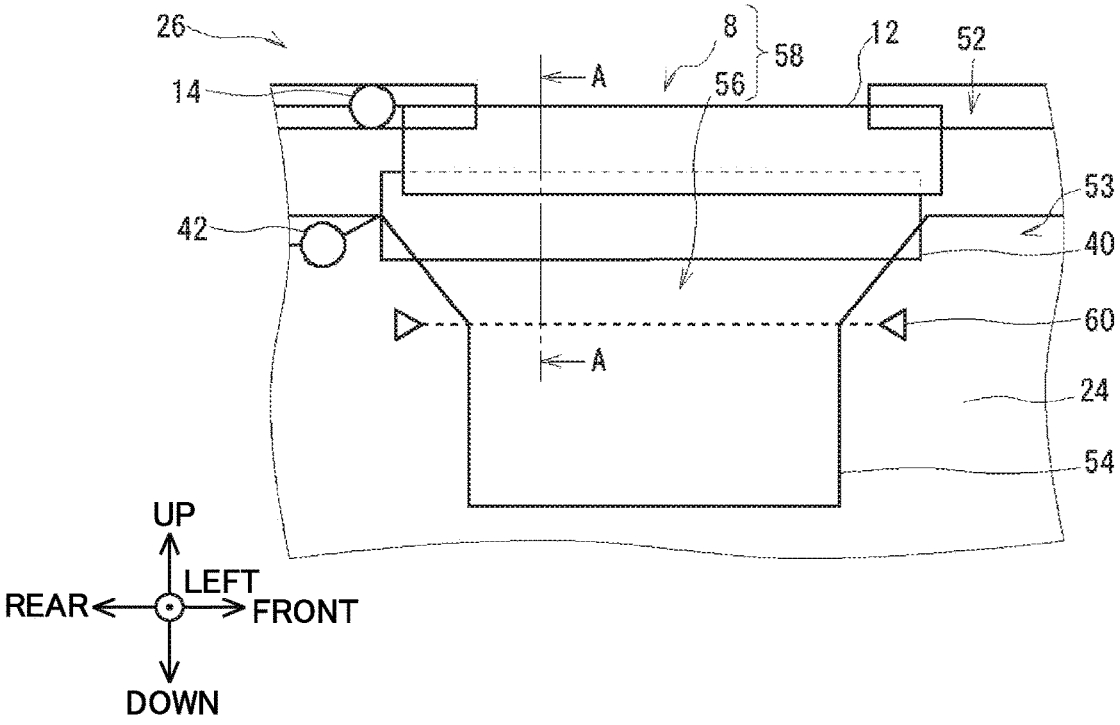
FIG. 5 is a left side view showing structure (1) of a money insert/dispensing portion.
Figure 6:
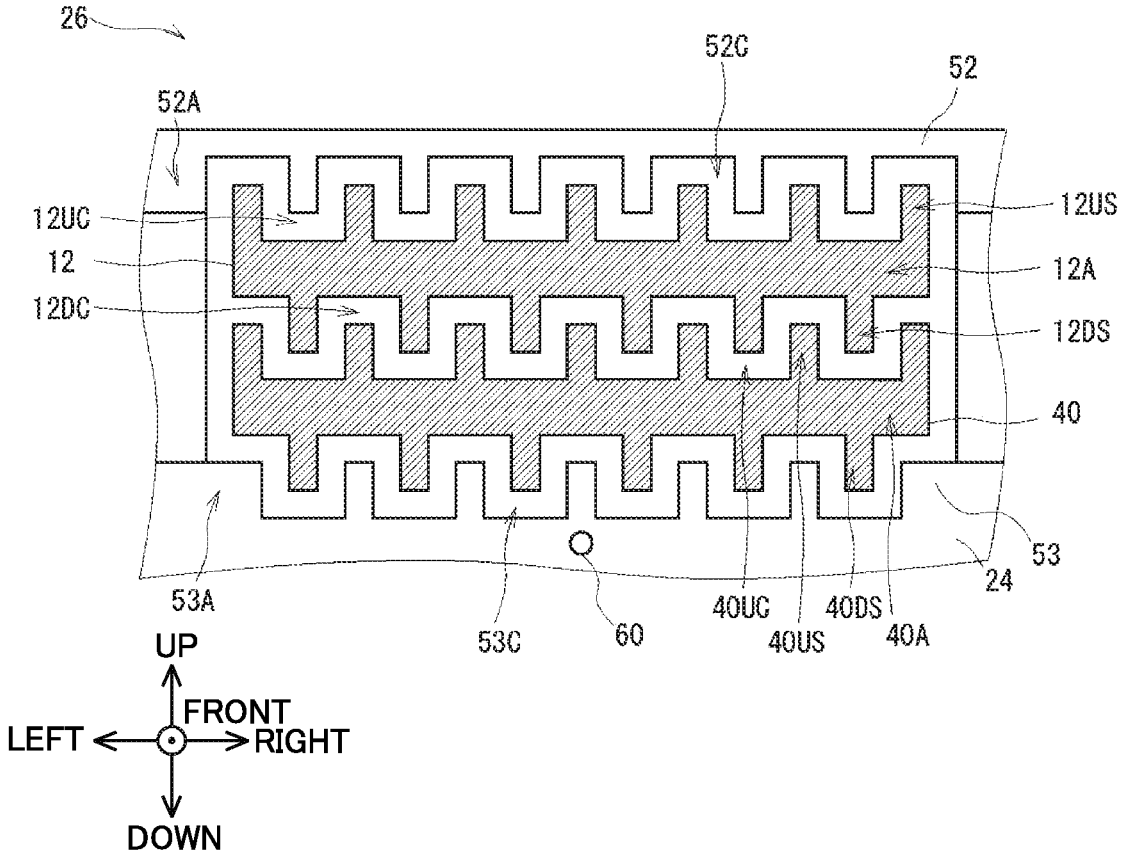
FIG. 6 shows structure (2) of the money insert/dispensing portion, and is a cross-sectional view along arrow A-A of FIG. 5.

As shown in FIG. 5 and FIG. 6, the money insert/dispensing portion 26 is structured mainly by a device money insert/dispensing port frame 52, the device shutter 12, the processor shutter 40, a processor money insert/dispensing port frame 53 and a bill accommodating portion 54.

The device money insert/dispensing port frame 52, that is a frame surrounding the device money insert/dispensing port 8 at the front panel 4, is shaped as a plate that has a predetermined thickness and that extends substantially in the horizontal direction, and is structured such that the internal structure of the bill processor 22 cannot be seen from the exterior. The device money insert/dispensing port 8 that is rectangular in plan view is formed as a hole in the device money insert/dispensing port frame 52. The bill accommodating portion 54, that is substantially U-shaped in cross-section, is provided at a lower portion of the device money insert/dispensing port 8.

A processor money insert/dispensing port 56 that is rectangular in plan view is formed at a position, that faces the device money insert/dispensing port 8, of the processor housing 24. A money insert/dispensing port 58, that communicates the bill accommodating portion 54 with the exterior, is formed by the device money insert/dispensing port 8 and the processor money insert/dispensing port 56. The processor money insert/dispensing port frame 53, that is a frame surrounding the processor money insert/dispensing port 56 at the processor housing 24, is structured in the shape of a plate that has a predetermined thickness and that extends substantially in the horizontal direction. The processor shutter 40 that is provided at the processor housing 24, and the device shutter 12 that is provided at the front panel 4 and is positioned at the upper side of the processor shutter 40, are provided as a so-called double shutter, between the exterior of the automatic cash transaction device 1 and the bill accommodating portion 54. The device shutter 12 and the processor shutter 40 are shapes in which a metal plate of a predetermined thickness is subjected to sheet metal working, and, by moving in the front-rear direction, open or close the bill accommodating portion 54 with respect to the exterior of the automatic cash transaction device 1.

As shown in FIG. 6, at the device shutter 12, plural device shutter upper side projecting portions 12US project-out toward the device money insert/dispensing port frame 52 from an upper surface of a device shutter plate portion 12A that is flat-plate-shaped and that extends in the front-rear and left-right directions. The plural device shutter upper side projecting portions 12US extend along the front-rear direction from a front end to a rear end of the device shutter plate portion 12A, and are provided at a predetermined interval in the left-right direction. Due thereto, device shutter upper side groove portions 12UC, that are shorter than the heights of the device shutter upper side projecting portions 12US, are formed between the device shutter upper side projecting portions 12US that are adjacent to one another. Further, at the device shutter 12, plural device shutter lower side projecting portions 12DS project-out toward the processor shutter 40 from a lower surface of the device shutter plate portion 12A. The plural device shutter lower side projecting portions 12DS extend along the front-rear direction from the front end to the rear end of the device shutter plate portion 12A and are provided at a predetermined interval in the left-right direction. The device shutter lower side projecting portions 12DS are provided at places that coincide with the device shutter upper side groove portions 12UC and whose positions are offset in the left-right direction from the device shutter upper side projecting portions 12US. Due thereto, device shutter lower side groove portions 12DC, that are shorter than the heights of the device shutter lower side projecting portions 12DS, are formed between the device shutter lower side projecting portions 12DS that are adjacent to one another.

At the device money insert/dispensing port frame 52, groove portions 52C of the device money insert/dispensing port frame are formed at places facing the device shutter upper side projecting portions 12US of the device shutter 12 so as to be concave toward the upper side. The groove portions 52C of the device money insert/dispensing port frame are disposed along the front-rear direction from a front end to a rear end of a plate portion 52A of the device money insert/dispensing port frame 52 that is flat-plate-shaped and extends in the front-rear and left-right directions.

The device money insert/dispensing port frame 52 and the device shutter 12 mesh together in a non-contact state due to the device shutter upper side projecting portions 12US entering into the groove portions 52C of the device money insert/dispensing port frame, and a so-called nested structure is formed along the transverse direction (the left-right direction). Due thereto, the device shutter 12 moves in the front-rear direction without contacting the device money insert/dispensing port frame 52, and bills are prevented from entering-in between the device shutter 12 and the device money insert/dispensing port frame 52.

At the processor shutter 40, processor shutter upper side projecting portions 40US project-out toward the device shutter 12 from an upper surface of a processor shutter plate portion 40A that is flat-plate-shaped and that extends in the front-rear and left-right directions. The processor shutter upper side projecting portions 40US extend along the front-rear direction from a front end to a rear end of the processor shutter plate portion 40A, and are disposed at places facing the device shutter lower side groove portions 12DC of the device shutter 12. Due thereto, processor shutter upper side groove portions 40UC, that are shorter than the heights of the processor shutter upper side projecting portions 40US, are formed between the processor shutter upper side projecting portions 40US that are adjacent to one another. Further, at the processor shutter 40, plural processor shutter lower side projecting portions 40DS project-out toward the processor money insert/dispensing port frame 53 from a lower surface of the processor shutter plate portion 40A. The plural processor shutter lower side projecting portions 40DS extend along the front-rear direction from the front end to the rear end of the processor shutter plate portion 40A at a predetermined interval in the left-right direction. The plural processor shutter lower side projecting portions 40DS are provided at places that coincide with the processor shutter upper side groove portions 40UC and whose positions are offset in the left-right direction from the processor shutter upper side projecting portions 40US.

At the processor money insert/dispensing port frame 53, groove portions 53C of the processor money insert/dispensing port frame are formed so as to be concave downward at places facing the processor shutter lower side projecting portions 40DS of the processor shutter 40. The groove portions 53C of the processor money insert/dispensing port frame extend along the front-rear direction from a front end to a rear end of a plate portion 53A of the processor money insert/dispensing port frame 53 that is flat-plate-shaped and extends in the front-rear and left-right directions.

The processor money insert/dispensing port frame 53 and the processor shutter 40 mesh together in a non-contact state due to the processor shutter lower side projecting portions 40DS entering into the groove portions 53C of the processor money insert/dispensing port frame, and a so-called nested structure is formed along the transverse direction. Due thereto, the processor shutter 40 moves in the front-rear direction without contacting the processor money insert/dispensing port frame 53, and bills are prevented from entering-in between the processor shutter 40 and the processor money insert/dispensing port frame 53.

The device shutter 12 and the processor shutter 40 mesh-together in a non-contact state due to the processor shutter upper side projecting portions 40US entering into the device shutter lower side groove portions 12DC and the device shutter lower side projecting portions 12DS entering into the processor shutter upper side groove portions 40UC, and a so-called nested structure is formed along the transverse direction. Due thereto, the device shutter 12 and the processor shutter 40 move in the front-rear direction without contacting one another, and bills are prevented from entering-in between the device shutter 12 and the processor shutter 40.

The hand sensor 60 that serves as a foreign object sensor is provided at the processor housing 24 such that the optical axis of the hand sensor 60 is positioned in a vicinity of a lower side of the processor shutter 40. The hand sensor 60 senses a foreign object such as a finger or the like of a user by whether or not the optical axis is blocked by an object or the like, and notifies the processor control section 20 of the results of sensing. In this way, by providing the hand sensor 60 at the lower side of the device shutter 12 and the processor shutter 40 (i.e., further toward the inner side of the processor housing 24 from the device shutter 12 and the processor shutter 40), the optical axis cannot be intentionally blocked from the exterior by the user.

[1-4. Effects]

Figure 14:
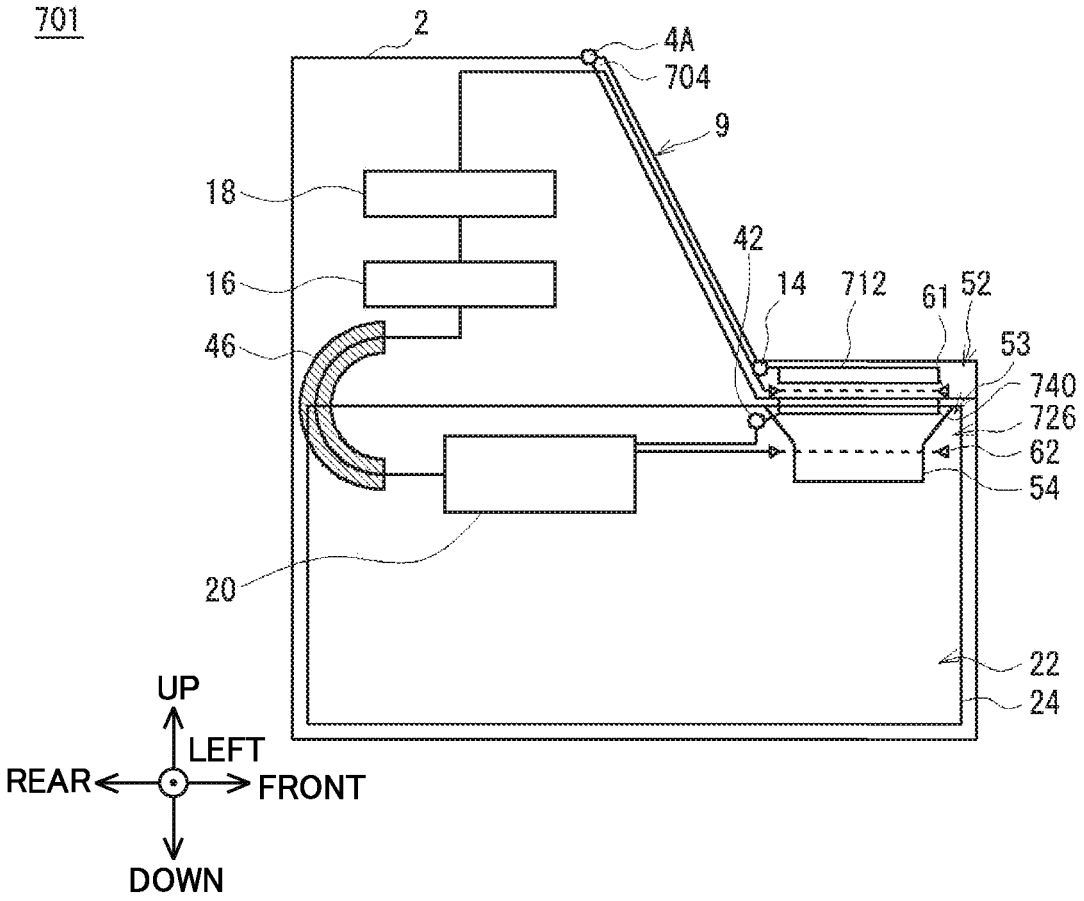
FIG. 14 is a left side view showing the structure of a conventional automatic cash transaction device.
Figure 15:
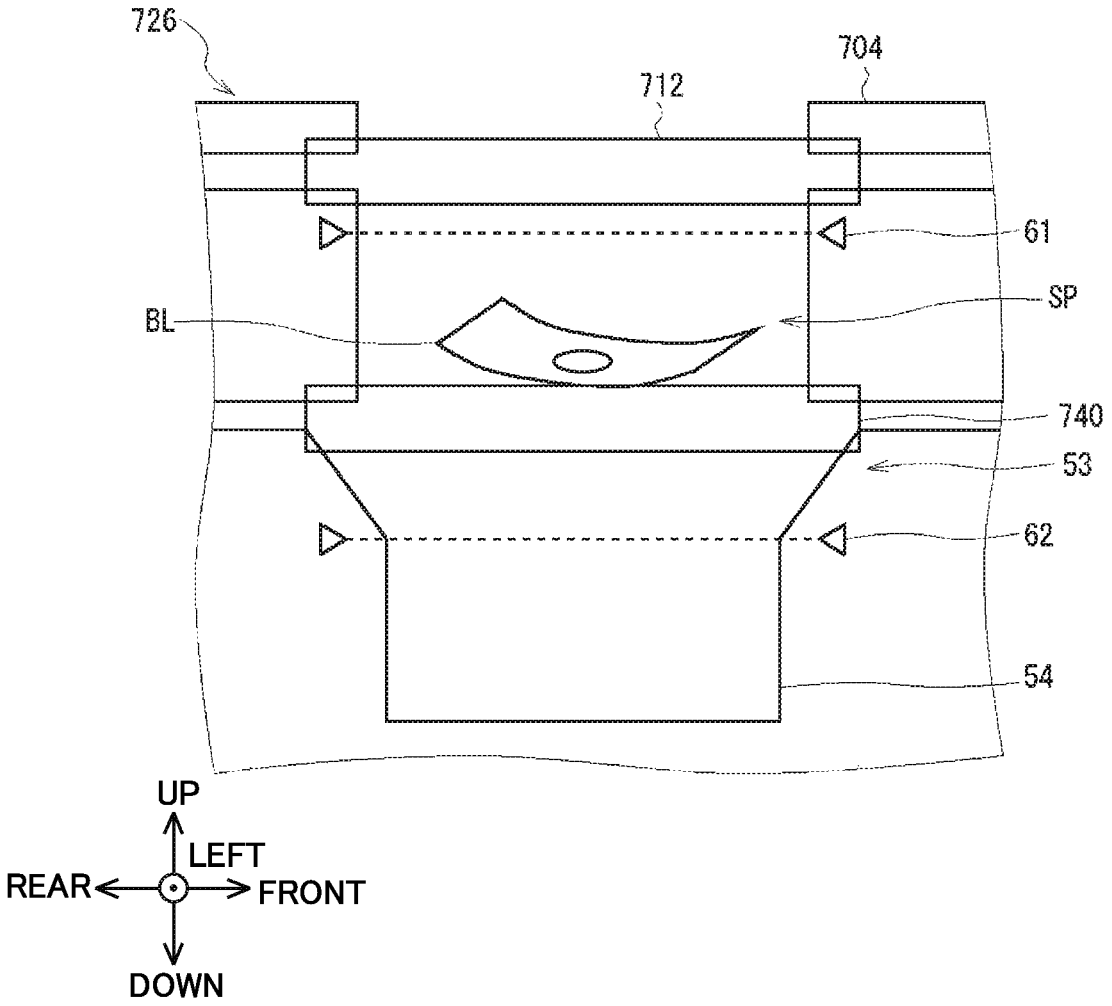
FIG. 15 is a left side view showing the structure of a conventional money insert/dispensing portion.

As shown in FIG. 14, at a conventional automatic cash transaction device 701, a sensor that senses nipping of a hand must be provided at the inner side of the shutter (the side away from the user) in order for the optical axis to not be intentionally blocked. And, because it is desirable for a device hand sensor 61 to be disposed in a vicinity of a device shutter 712 in order for the device shutter 712 to be able to move together with a front panel 704, the device hand sensor 61 is provided beneath the device shutter 712 at the front panel 704, and a processor hand sensor 62 is provided beneath a processor shutter 740.

In contrast, at the automatic cash transaction device 1, as compared with the conventional automatic cash transaction device 701, the device hand sensor 61 that was provided between the device shutter 712 and the processor shutter 740 is omitted. Due thereto, at the automatic cash transaction device 1, the number of parts is reduced and the structure can be simplified.

Further, by the processor control section 20 that is provided at the interior of the processor housing 24, the automatic cash transaction device 1 acquires results of detection from the hand sensor 60 that is provided at the processor housing 24, and controls both the processor shutter 40 that is provided at the processor housing 24, and the device shutter 12 that is provided at the front panel 4 that is at the exterior of the processor housing 24.

As shown in FIG. 14, at the conventional automatic cash transaction device 701, a money insert/dispensing portion 726 was controlled by the customer interface control section 18 and the processor control section 20 independently of one another. Namely, by the customer interface control section 18 that was provided at the interior of the device housing 2 and at the exterior of the processor housing 24, the conventional automatic cash transaction device 701 acquired the results of detection from the device hand sensor 61 that was provided at the front panel 4, and controlled the device shutter 712 that was provided at the front panel 4. And, by the processor control section 20 that was provided at the interior of the processor housing 24, the conventional automatic cash transaction device 701 acquired the results of detection from the processor hand sensor 62 that was provided at the processor housing 24, and controlled the processor shutter 740 that was provided at the processor housing 24. Therefore, at the conventional automatic cash transaction device 701, the device hand sensor 61 had to be provided in addition to the processor hand sensor 62, and, in order to place this hand sensor 61, a space SP for a sensor that is shown in FIG. 14 was provided between the device shutter 712 and the processor shutter 740. However, in this case, there was the possibility that a bill BL would remain in this space SP for a sensor, and that a mistake in cash calculation, in which cash is handed-over to the customer who carries out the next transaction, would arise.

In contrast, at the automatic cash transaction device 1 in accordance with the present embodiment, the only one hand sensor 60 is provided at the inner side of the processor shutter 40. Due thereto, at the automatic cash transaction device 1, the need to form the space SP for a sensor between the device shutter 12 and the processor shutter 40 can be eliminated, and it is difficult for a bill to remain between the device shutter 12 and the processor shutter 40.

Moreover, at the automatic cash transaction device 1, the device shutter 12 and the processor shutter 40 are made to be a nested structure. Due thereto, it can be made even more difficult for bills to remain between the device shutter 12 and the processor shutter 40.

Further, at the conventional automatic cash transaction device 701, the customer interface control section 18 and the processor control section 20 operated independently of one another, and data was exchanged therebetween via the integrated control section 16. Therefore, in the conventional automatic cash transaction device 701, it was difficult to grasp in real time the states of the respective hand sensors (the hand sensor 61 and the hand sensor 62). Therefore, in the conventional automatic cash transaction device 701, the device hand sensor 61 was provided at the device shutter 712 and the processor hand sensor 62 was provided at the processor shutter 740, respectively, and the device hand sensor 61 and the processor hand sensor 62 were respectively controlled independently of one another by the customer interface control section 18 and the processor control section 20.

In contrast, at the automatic cash transaction device 1, only the one hand sensor 60 is provided, and control of the device shutter 712, that was conventionally carried out by the customer interface control section 18, is transferred to the processor control section 20. Due thereto, by only the processor control section 20, the automatic cash transaction device 1 can control both the device shutter 12 and the processor shutter 40, and the need to exchange data relating to control of the shutters between the processor control section 20 and the customer interface control section 18 also is eliminated, and control can be made to be simple.

In accordance with the above-described structure, the automatic cash transaction device 1 has the device housing 2, and the bill processor 22. The device housing 2 is provided with the customer interface portion 6 that receives operations relating to bills that are paper-sheet-like media, the device money insert/dispensing port 8 that serves as a device insert/dispensing port into and from which the bills are inserted and dispensed, and the device shutter 12 that opens and closes the device money insert/dispensing port 8. The bill processor 22 is provided at the interior of the device housing 2 and serves as a media processor that carries out processing relating to bills. The bill processor 22 has the processor money insert/dispensing port 56 that serves as a processor insert/dispensing port that is disposed so as to face the device money insert/dispensing port 8 and into and from which bills are inserted and dispensed, and the processor shutter 40 that opens and closes the processor money insert/dispensing port 56. The automatic cash transaction device 1 is further provided with the bill accommodating portion 54, the customer interface control section 18, the processor control section 20, and the hand sensor 60. The bill accommodating portion 54 is provided at the interior of the bill processor 22 and is opened or closed-off with respect to the exterior via the device money insert/dispensing port 8 and the processor money insert/dispensing port 56 by opening/closing of the device shutter 12 and the processor shutter 40. The customer interface control section 18 is provided at the exterior of the bill processor 22 at the interior of the device housing 2, and that controls the customer interface portion 6. The processor control section 20 is provided at the interior of the bill processor 22 and that controls the bill processor 22. The hand sensor 60 is provided further toward the inner side of the bill processor 22 from the processor shutter 40, and detects the absence/presence of a foreign object at the bill accommodating portion 54. Either one of the customer interface control section 18 or the processor control section 20 acquires results of sensing of the hand sensor 60, and controls the device shutter 12 and the processor shutter 40.

Due thereto, at the automatic cash transaction device 1, there is no need to provide the hand sensor 60 at the device shutter 12 and the processor shutter 40 respectively, and either one of the customer interface control section 18 or the processor control section 20 acquires the results of sensing of the hand sensor 60 and can control the device shutter 12 and the processor shutter 40.

2. Second Embodiment

[2-1. Structures of Automatic Cash Transaction Device and Bill Processor]

Figure 7:
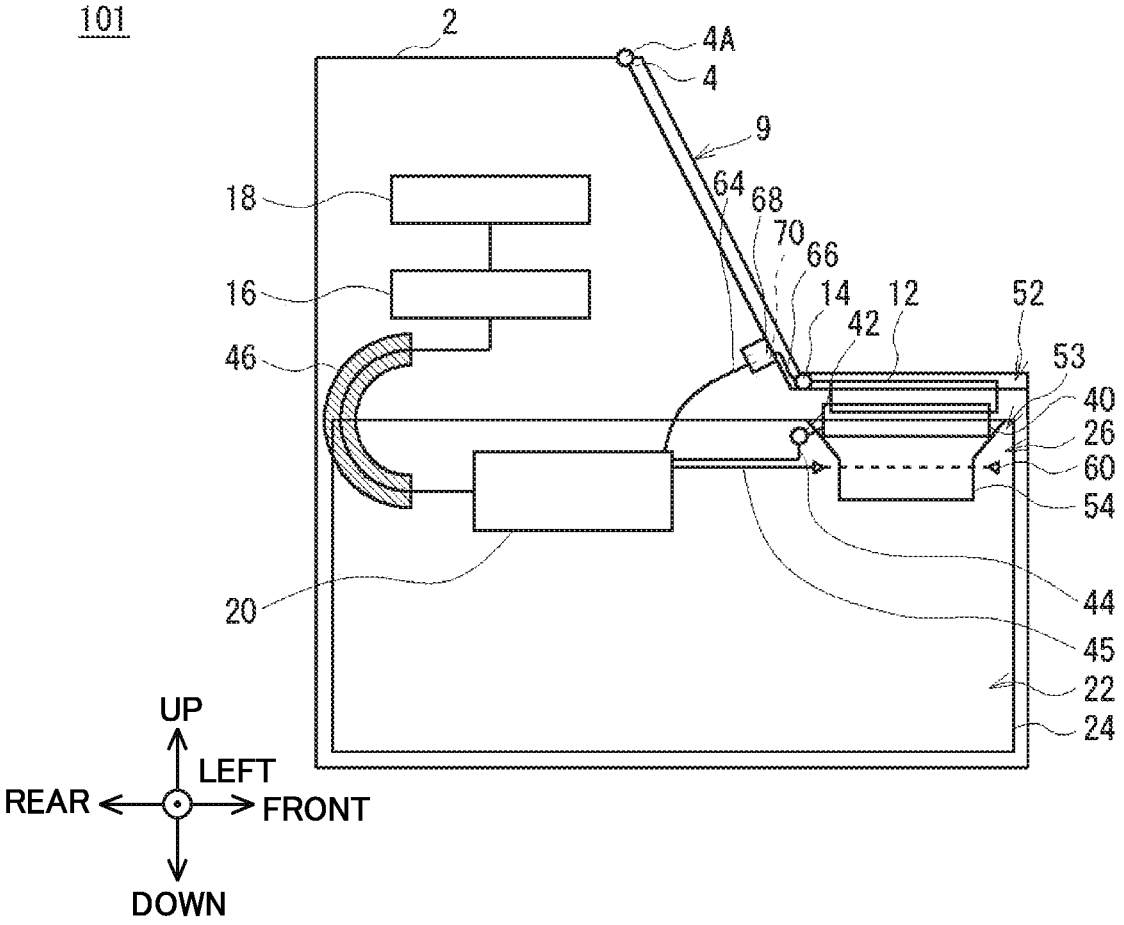
FIG. 7 is a left side view showing the structure of an automatic cash transaction device in the front panel closed state in accordance with a second embodiment.

As shown in FIG. 1 and FIG. 7, as compared with the automatic cash transaction device 1 in accordance with the first embodiment, at an automatic cash transaction device 101 in accordance with a second embodiment, a wiring cable 64 and a jack 68 (a first member 68) and a wiring cable 66 and a plug 70 (a second member 70) are added in replace of the wiring cable 48, but other than this, the automatic cash transaction device 101 is structured similarly. The jack 68 and the plug 70 are wiring connection members for connecting the wiring cables 64 and 66 (a first wire).

Figure 8:
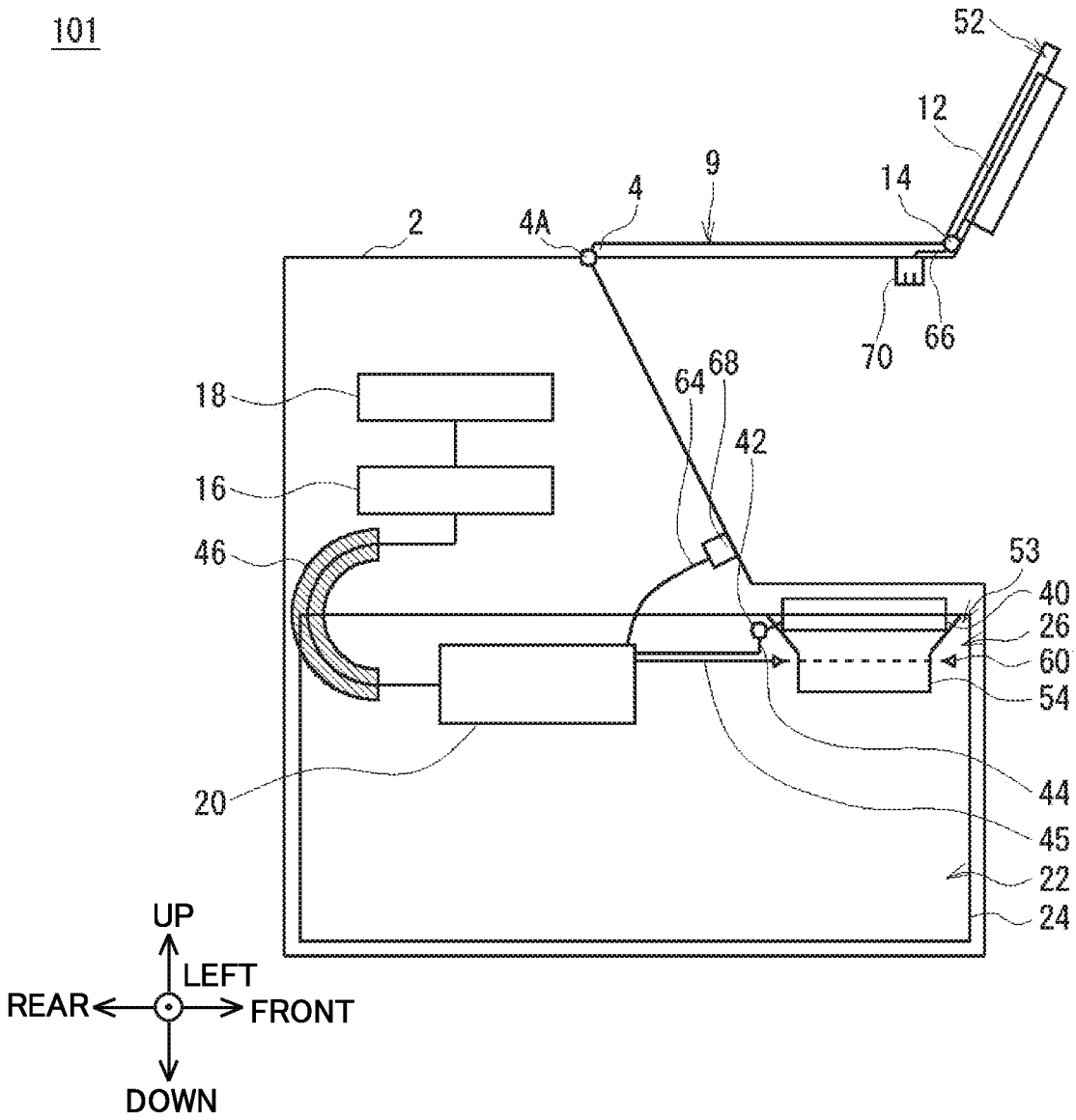
FIG. 8 is a left side view showing the structure of the automatic cash transaction device in the front panel opened state in accordance with the second embodiment.

The wiring cable 64 is routed from the interior of the processor housing 24 to beneath the operation/display portion 9 at the rear of the device shutter 12 at the device housing 2 interior, and the jack 68 is connected to the distal end of this wiring cable 64. The wiring cable 66 is routed toward the rear from the device shutter motor 14 and the device shutter position detecting sensor (not shown), and the plug 70 that is attachable to and detachable from the jack 68 are connected to the distal end of this wiring cable 66. In the front panel closed state that is shown in FIG. 7, due to the jack 68 and the plug 70 being fit-together and the wiring cable 64 and the wiring cable 66 becoming conductive, the processor control section 20 acquires the results of detection of the device shutter 12 from the device shutter position detecting sensor, and opens and closes the device shutter 12 by driving the device shutter motor 14. On the other hand, in the front panel opened state that is shown in FIG. 8, due to the plug 70 being separated and removed from the jack 68, the wiring cable 64 and the wiring cable 66 are disconnected.

At the automatic cash transaction device 1 in accordance with the first embodiment, the wiring cable 48 is routed from the processor control section 20 to the device housing 2 interior, and passes-by a vicinity of the front panel supporting point 4A, and is connected to the device shutter motor 14 and the device shutter position detecting sensor. Therefore, the routing of the wiring cable becomes long, noise or the like is superposed, and there is the possibility that the good quality of communication cannot be ensured.

In contrast, at the automatic cash transaction device 101, the wiring cable 64 is laid from the processor control section 20 toward the device shutter motor 14 without passing-by a vicinity of the front panel supporting point 4A, and, in the front panel closed state, the jack 68 and the plug 70 are fit-together, and the wiring cable 64 and the wiring cable 66 are made to be conductive. Due thereto, at the automatic cash transaction device 101, the length over which the wiring cable is routed can be made to be shorter than in the automatic cash transaction device 1, and the quality of communication is maintained, and the device shutter 12 can be controlled reliably by the processor control section 20.

Further, in the front panel opened state, because there is no opening and closing of the device shutter 12, even if the plug 70 is removed from the jack 68 and the device shutter 12 can no longer be controlled by the processor control section 20, there is no problem in actual use.

In addition, the automatic cash transaction device 101 in accordance with the second embodiment exhibits operation and effects that are substantially equivalent to those of the automatic cash transaction device 1 in accordance with the first embodiment.

2. Third Embodiment

[3-1. Structures of Automatic Cash Transaction Device and Bill Processor]

Figure 9:
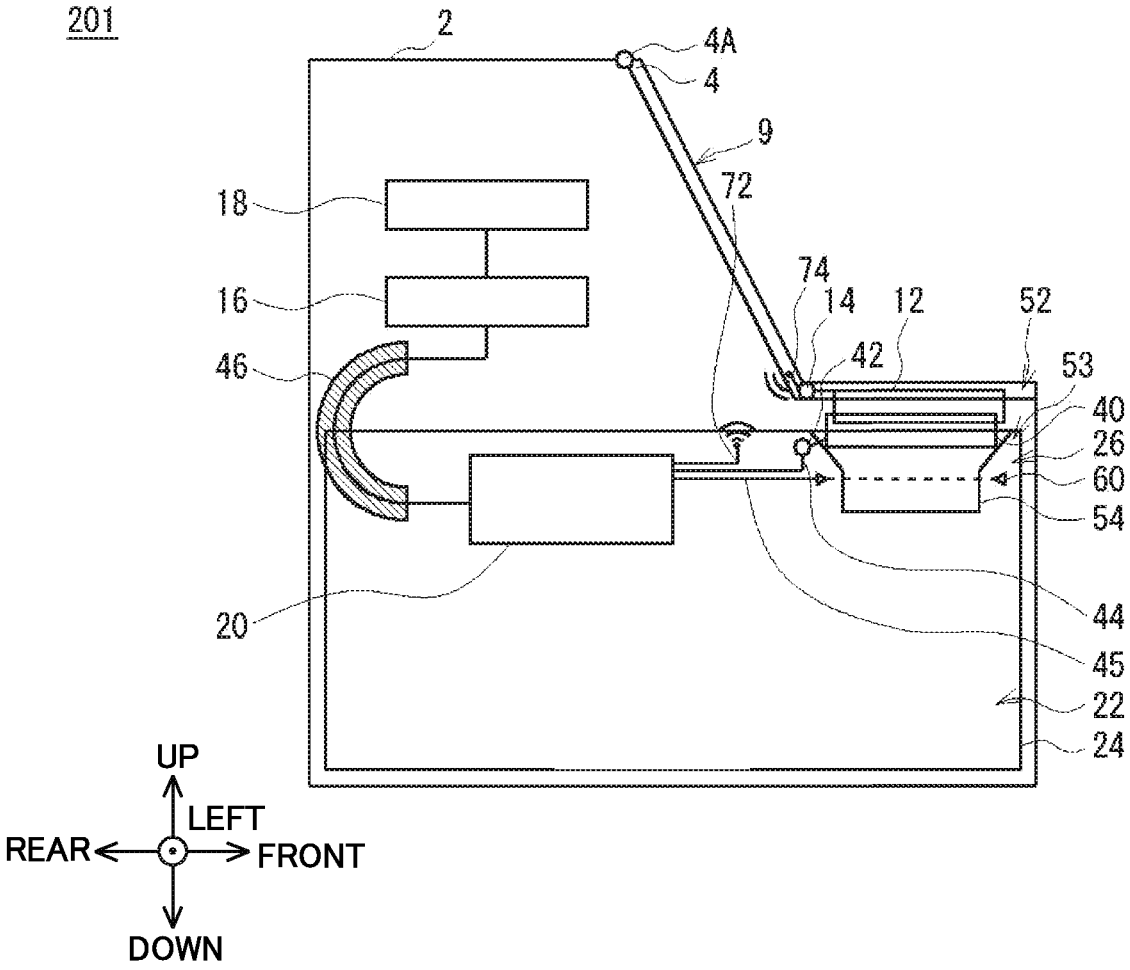
FIG. 9 is a left side view showing the structure of an automatic cash transaction device in the front panel closed state in accordance with a third embodiment.

As shown in FIG. 1 and FIG. 9, as compared with the automatic cash transaction device 1 in accordance with the first embodiment, at an automatic cash transaction device 201 in accordance with a third embodiment, the wiring cable 48 is eliminated, and a processor communicator 72 and a device communicator 74 are added, but other than this, the automatic cash transaction device 201 is structured similarly.

The processor communicator 72 that carries out wireless communication by radio waves is connected to the processor control section 20. The device communicator 74 that carries out wireless communication with the processor communicator 72 by radio waves is connected to the device shutter motor 14 and to the device shutter position detecting sensor (not illustrated). In the front panel closed state, the processor control section 20 acquires the results of detection of the device shutter 12 from the device shutter position detecting sensor by wireless communication, and opens and closes the device shutter 12 by transmitting, by wireless communication, a control command to drive the device shutter motor 14.

In the automatic cash transaction device 1 in accordance with the first embodiment, the wiring cable 48 is routed from the processor control section 20 to the device housing 2 interior and passes-by a vicinity of the front panel supporting point 4A, and is connected to the device shutter motor 14 and to the device shutter position detecting sensor. Therefore, the routing of the wiring cable becomes long, noise or the like is superposed, and there is the possibility that the good quality of communication cannot be ensured.

In contrast, at the automatic cash transaction device 201, the wiring cable 48, that is routed from the processor control section 20 to the device shutter motor 14 and the device shutter position detecting sensor, is omitted, and the processor control section 20 controls the device shutter motor 14 by wireless communication. Due thereto, at the automatic cash transaction device 201, the wiring cable 48 that is routed from the processor control section 20 to the device shutter motor 14 and the device shutter position detecting sensor, can be eliminated, and the quality of communication is maintained, and the device shutter 12 can be reliably controlled by the processor control section 20.

Figure 10:
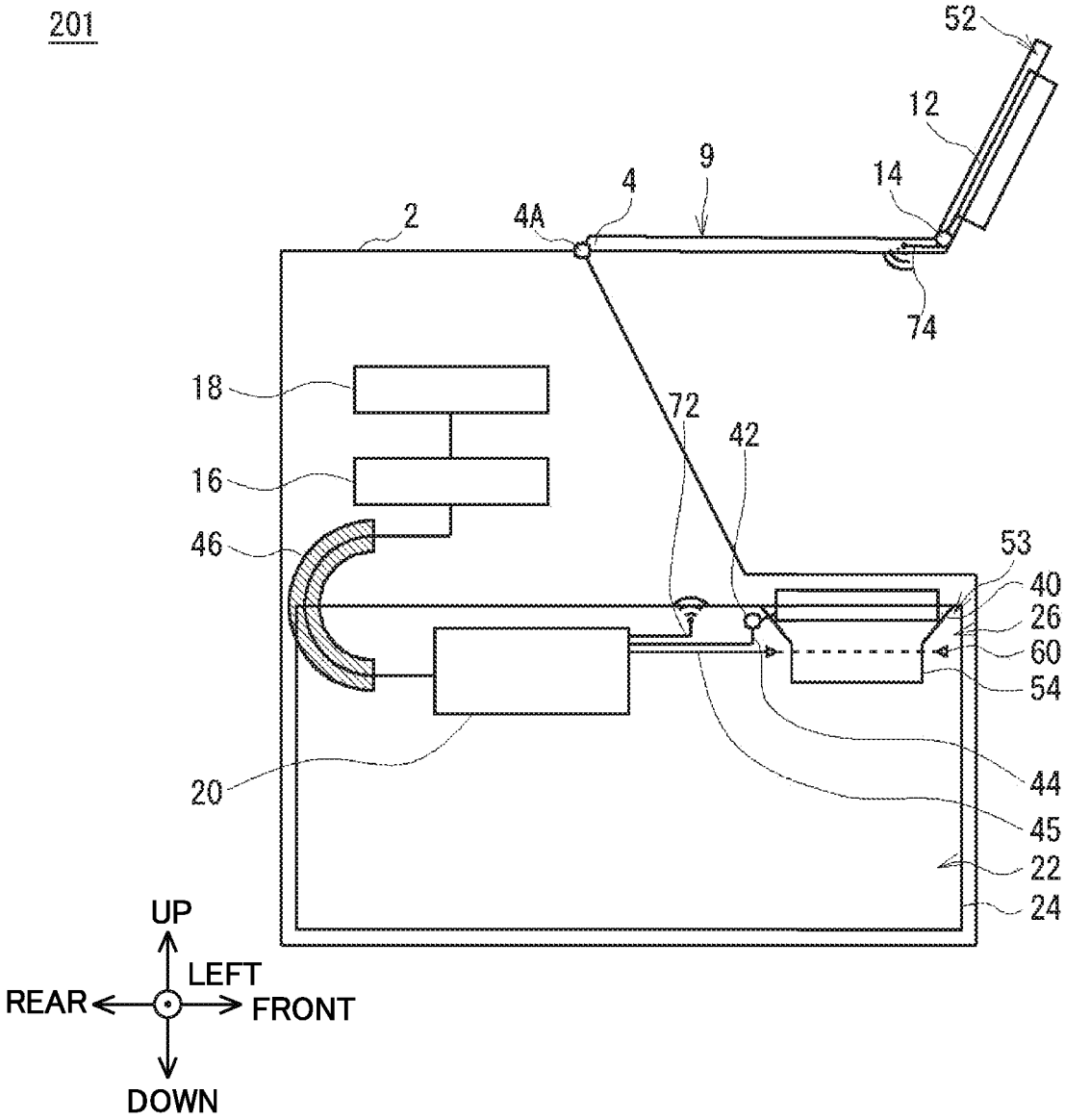
FIG. 10 is a left side view showing the structure of the automatic cash transaction device in the front panel opened state in accordance with the third embodiment.

Further, in the front panel opened state that is shown in FIG. 10, because there is no opening and closing of the device shutter 12, the device communicator 74 is further apart from the processor communicator 72 than in a case of the front panel closed state, and there are no problems in actual use even if the device communicator 74 cannot receive the radio waves of the processor communicator 72. Further, in the front panel opened state, there is no need for the processor communicator 72 and the device communicator 74 to communicate wirelessly in this way. Therefore, by making it such that radio waves are not transmitted, the possibility of radio waves that are transmitted by the processor communicator 72 interfering with and affecting the various types of mechanisms and other devices and the like within the automatic cash transaction device 201 can be lowered.

In addition, the automatic cash transaction device 201 in accordance with the third embodiment exhibits operation and effects that are substantially equivalent to those of the automatic cash transaction device 1 in accordance with the first embodiment.

4. Other Embodiments

Note that the above-described first embodiment describes a case in which the device shutter 12 and the processor shutter 40 are made to be so-called nested structures. The present invention is not limited to this, and the device shutter 12 and the processor shutter 40 do not have to be made to be nested structures. Further, the device shutter upper side projecting portions 12US and the device shutter lower side projecting portions 12DS do not have to be formed at the device shutter 12, and the processor shutter upper side projecting portions 40US and the processor shutter lower side projecting portions 40DS do not have to be formed at the processor shutter 40. In this case, having the processor shutter and the device shutter be as close as possible to the extent that they do not contact one another can reduce the possibility of bills getting mixed-in between the processor shutter and the device shutter. The same is applicable for the second and third embodiments as well.

Further, the above-described second embodiment describes a case in which the wiring cable 64 is routed from the interior of the processor housing 24 to beneath the operation/display portion 9 at the rear of the device shutter 12 at the device housing 2 interior. The present invention is not limited to this, and the wiring cable 64 may be routed toward either of the left and right sides of the operation/display portion 9, or toward the front side of the device shutter 12, or the like. In short, it suffices for the wiring cable 64 to pass as much as possible further toward the lower side than a vicinity of the front panel supporting point 4A, and for the routed distance to be as short as possible.

Moreover, the above-described second embodiment describes a case in which the jack 68 is connected to the wiring cable 64, and the plug 70, that is fit-together with this jack 68, is connected to the wiring cable 66. The present invention is not limited to this, and various types of wire connecting members such as a connector or the like, that makes it possible to electrically connect the wiring cable 64 and the wiring cable 66 and that are easily detachable, may be used.

Moreover, the above-described third embodiment describes a case in which wireless communication is carried out between the processor communicator 72 and the device communicator 74 by radio waves. The present invention is not limited to this, and the wireless communication may be carried out by using various types of wireless communication technologies such as carrier waves of light, sound, or the like.

Figure 11:
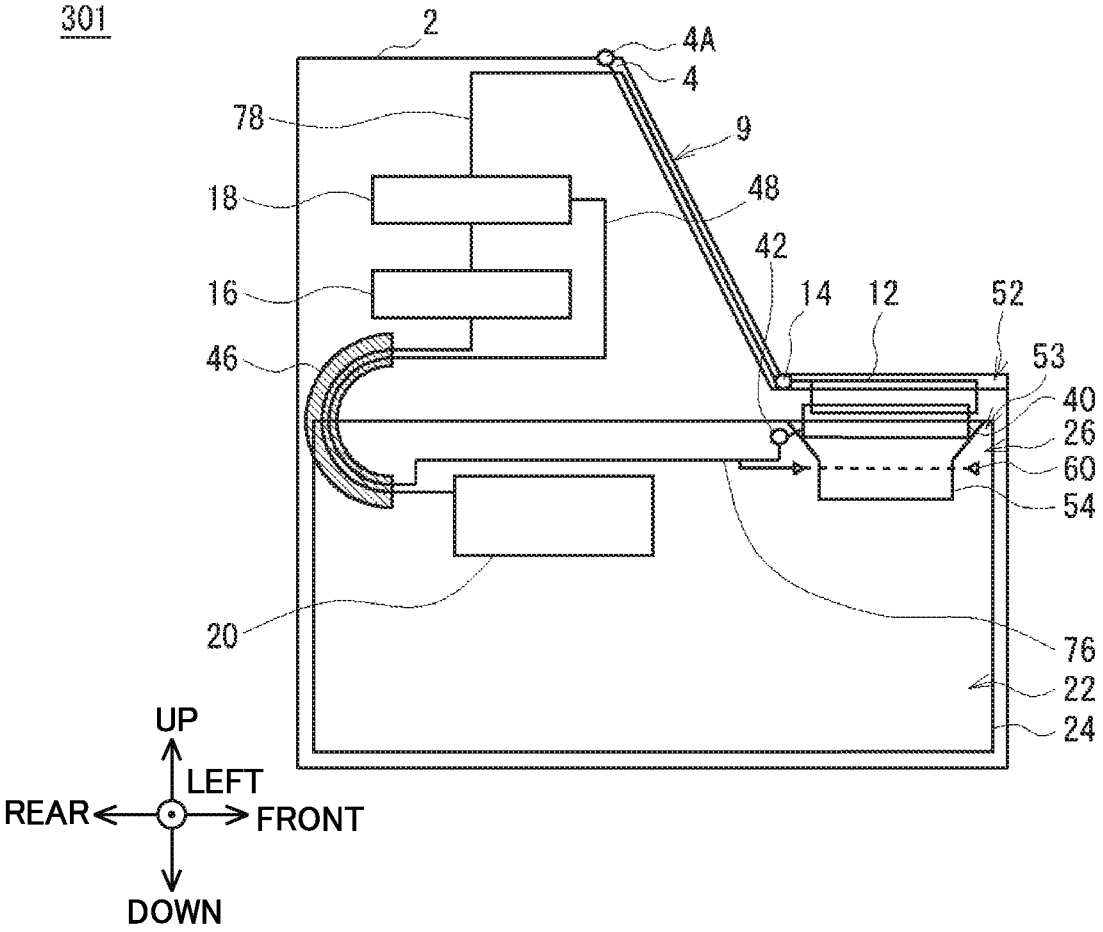
FIG. 11 is a left side view showing the structure of an automatic cash transaction device in accordance with another embodiment.

Moreover, the above embodiments describe cases in which the device shutter 12 and the processor shutter 40 are controlled by the processor control section 20. The present invention is not limited to this, and, as at an automatic cash transaction device 301 shown in FIG. 11, the device shutter 12 and the processor shutter 40 may be controlled at the customer interface control section 18 by causing the wiring cable 78 to, from the customer interface control section 18 at the interior of the device housing 2, pass by a vicinity of the front panel supporting point 4A and pass along the side of the operation/display portion 9, and routing the wiring cable 78 to the device shutter motor 14 and the device shutter position detecting sensor (not shown), and routing a wiring cable 76 toward the processor housing 24 interior without going through the integrated control section 16, and connecting the wiring cable 76 to the processor shutter motor 42 and to the processor shutter position detecting sensor without going through the processor control section 20. However, because the hand sensor 60 is provided beneath the processor shutter 40, controlling the device shutter 12 and the processor shutter 40 by the processor control section 20 can make the routing of the wiring cable be short, for controlling the processor shutter 40. Further, at the automatic cash transaction device 301 as well, as at the automatic cash transaction device 101, a wiring cable, to whose distal end a jack is connected, may be routed from the customer interface control section 18 toward the processor shutter motor 42, and a wiring cable, to whose distal end a plug is connected, may be routed from the processor shutter motor 42, and this jack and plug may be fit-together in the shutter closed state. Moreover, at the automatic cash transaction device 301 as well, as at the automatic cash transaction device 201, wireless communication may be carried out between a device communicator, that is connected to the customer interface control section 18, and a processor communicator, that is connected to the processor shutter motor 42 and to the processor shutter position detecting sensor.

Moreover, the above-described embodiments describe cases in which the hand sensor 60 is provided such that the optical axis thereof is positioned in a vicinity of the lower side of the processor shutter 40. The present invention is not limited to this, and, as at a money insert/dispensing portion 426 shown in FIG. 12, the hand sensor 60 may be provided at a position at which the optical axis thereof overlaps the locus of movement of a processor shutter 440.

Figure 12:
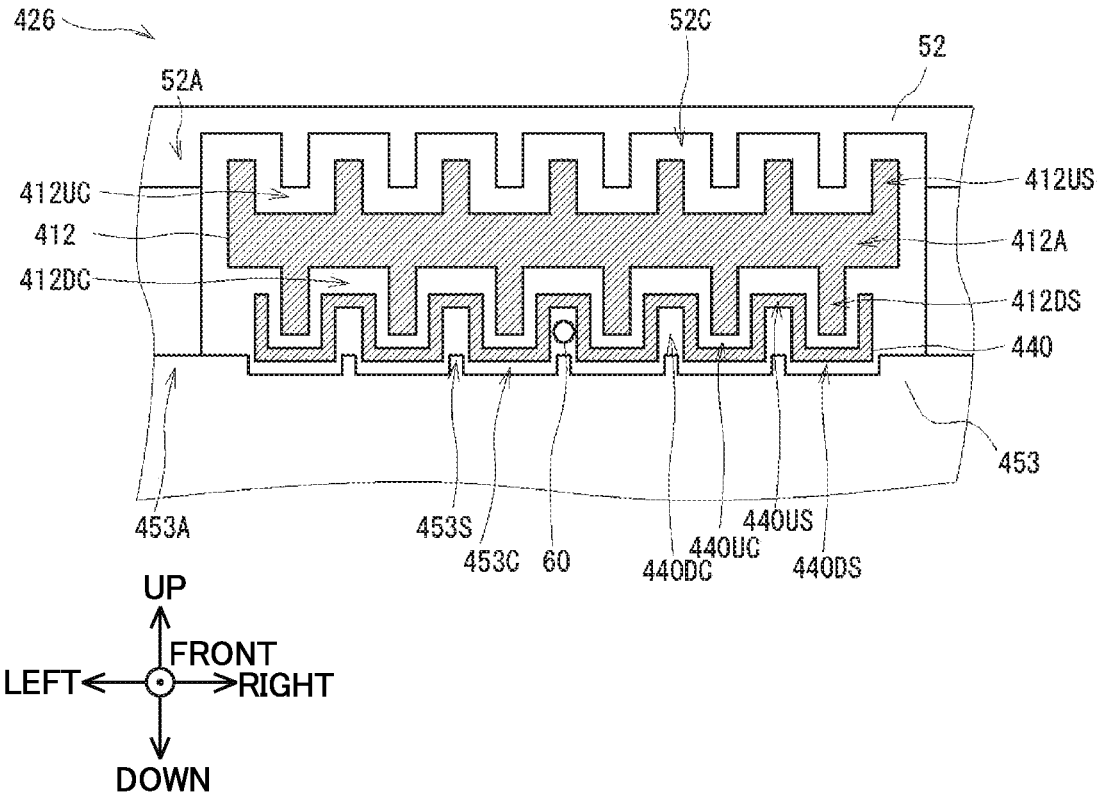
FIG. 12 is a cross-sectional view showing structure (1) of a money insert/dispensing portion in accordance with another embodiment.

As shown in FIG. 12, at a device shutter 412, the height of device shutter lower side projecting portions 412DS is longer than that of the device shutter lower side projecting portions 12DS (FIG. 6) of the first embodiment. Further, at a processor money insert/dispensing port frame 453, a width in the left-right direction of groove portions 453C of processor money insert/dispensing port frame is wider than that of the groove portions 53C of the processor money insert/dispensing port frame, and projecting portions 453S of processor money insert/dispensing port frame, that project-out toward the processor shutter 440 more than groove portions 453C of the processor money insert/dispensing port frame, are formed between the groove portions 453C that are adjacent to one another.

The processor shutter 440 is a shape in which S-shaped cross-sections are continuous in the left-right direction. Further, at the processor shutter 440, processor shutter upper side convex portions 440US, that are substantially U-shaped in cross-section and that project-out toward the device shutter 412 are formed at places that face device shutter lower side groove portions 412DC of the device shutter 412. The processor shutter upper side convex portions 440US extend along the front-rear direction from a front end to a rear end of the processor shutter 440. Processor shutter upper side concave portions 440UC, that are further apart from the device shutter 412 from the processor shutter upper side convex portions 440US, are formed between the processor shutter upper side convex portions 440US that are adjacent to each other. Further, at the processor shutter 440, processor shutter lower side convex portions 440DS, that are substantially U-shaped in cross-section and that project-out toward the processor money insert/dispensing port frame 453, are formed at places that face the groove portions 453C of the processor money insert/dispensing port frame 453. The processor shutter lower side convex portions 440DS extend along the front-rear direction from the front end to the rear end of the processor shutter 440. Due thereto, processor shutter lower side concave portions 440DC, that are further apart from the processor money insert/dispensing port frame 453 than the processor shutter lower side convex portions 440DS, are formed between the processor shutter lower side convex portions 440DS that are adjacent to one another.

The hand sensor 60 is provided such that the optical axis thereof is positioned at the inner side of the processor shutter lower side concave portion 440DC of the processor shutter 40, and at the upper side of the projecting portion 453S of the processor money insert/dispensing port frame 453.

Here, at the money insert/dispensing section 26 in accordance with the first embodiment, the processor shutter 40 exists between the device shutter 12 and the hand sensor 60, as compared with a case in which a hand sensor was provided between the device shutter 712 and the processor shutter 740 as at the conventional money insert/dispensing portion 726. Thus, the distance from the device shutter 12 to the hand sensor 60 is larger than the distance from the device shutter 712 to the device hand sensor 61. Therefore, for example, even in a case in which a finger of the user exists on the locus of movement of the device shutter 12, if the finger does not reach as far as the optical axis of the hand sensor 60, the hand sensor 60 cannot sense the finger of the user. Therefore, there is the possibility that the automatic cash transaction device 1 cannot stop the device shutter 12 that is starting to close.

In contrast, at the money insert/dispensing portion 426, the optical axis of the hand sensor 60 is positioned between the top end portion (the top surface of the processor shutter upper side convex portion 440US) and the bottom end portion (the bottom surface of the processor shutter lower side convex portion 440DS) of the processor shutter 440.

Due thereto, at the money insert/dispensing portion 426, the distance between the processor money insert/dispensing port frame 453 and the device money insert/dispensing port frame 52 that is set in advance is not changed, and the optical axis of the hand sensor 60 can be made to be close to the device shutter 412 as compared with at the money insert/dispensing section 26, while the nested structure of the processor money insert/dispensing port frame 453 and the processor shutter 440, and the nested structure of the processor shutter 440 and the device shutter 412, are maintained. Therefore, it can be made difficult for a state, in which a finger of the user exists on the locus of movement of the device shutter 412 but the finger does not reach as far as the hand sensor 60, to arise, and the stability can be further improved.

Further, because the optical axis of the hand sensor 60 is disposed at a position that overlaps the locus of movement of the processor shutter 40, at the money insert/dispensing portion 426, it can be made difficult for a state, in which a finger of the user exists on the locus of movement of the processor shutter 440 but the finger does not reach as far as the hand sensor 60, to arise, and the stability can be further improved.

Figure 13:
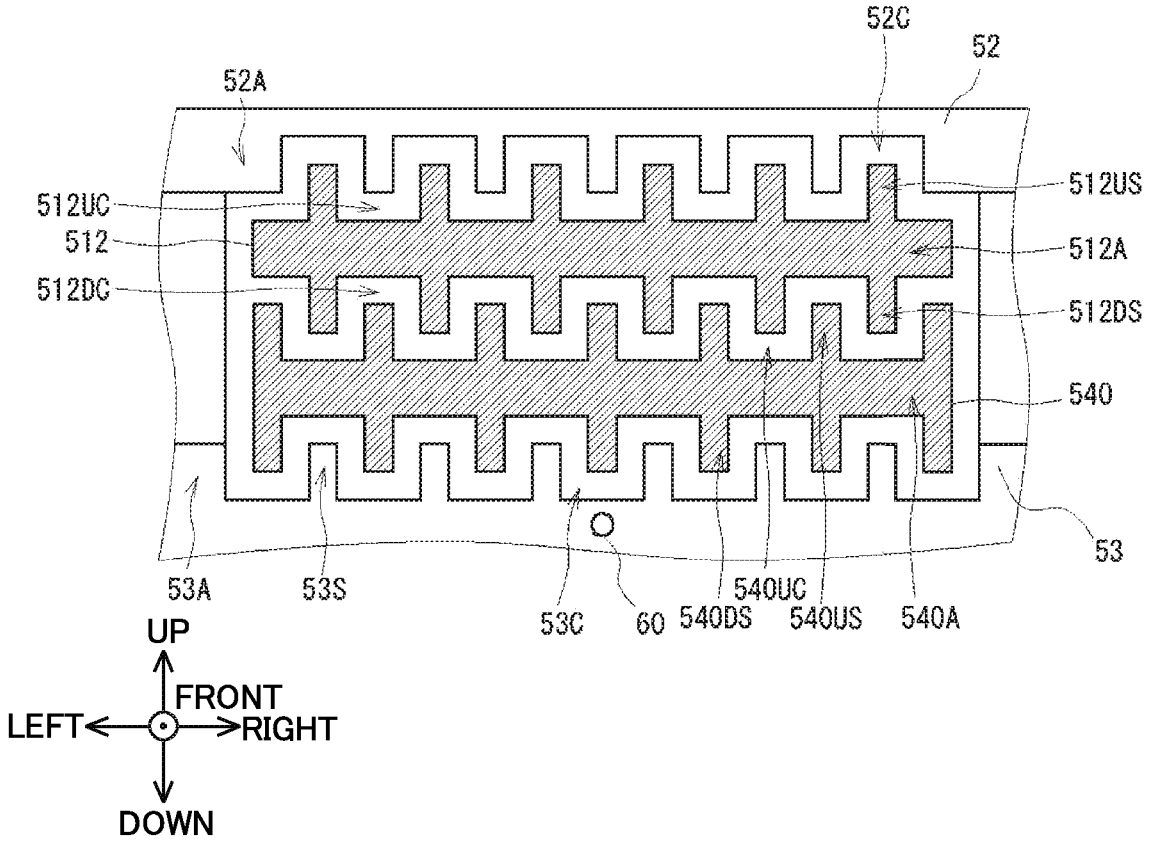
FIG. 13 is a cross-sectional view showing structure (2) of a money insert/dispensing portion in accordance with another embodiment.

Further, a device shutter 512 and a processor shutter 540 may be the structures shown in FIG. 13. At the device shutter 512, plural device shutter upper side projecting portions 512US project-out from the upper surface of a device shutter plate portion 512A toward the device money insert/dispensing port frame 52. The upper surface of a device shutter plate portion 512A is flat-plate-shaped and extends in the front-rear and left-right directions. The device shutter upper side projecting portions 512US extend from the front end to the rear end along the front-rear direction and are provided at a predetermined interval in the left-right direction of the upper surface. Due thereto, device shutter upper side groove portions 512UC, that are shorter than the heights of the device shutter upper side projecting portions 512US, are formed between the device shutter upper side projecting portions 512US that are adjacent to one another. Further, at the device shutter 512, plural device shutter lower side projecting portions 512DS project-out from the lower surface of the device shutter plate portion 512A toward the processor shutter 540. The device shutter lower side projecting portions 512DS extend from the front end to the rear end along the front-rear direction of the lower surface at places that coincide with positions of the device shutter upper side projecting portions 512US in the left-right direction. The device shutter lower side projecting portions 512DS are provided at a predetermined interval in the left-right direction. Due thereto, device shutter lower side groove portions 512DC, that are shorter than the heights of the device shutter lower side projecting portions 512DS, are formed between the device shutter lower side projecting portions 512DS that are adjacent to one another.

At the processor shutter 540, processor shutter upper side projecting portions 540US project-out toward the device shutter 512. The processor shutter upper side projecting portions 540US extend from the front end to the rear end along the front-rear direction at the upper surface of a processor shutter plate portion 540A, that is flat-plate-shaped and that extends in the front-rear and left-right directions. The processor shutter upper side projecting portions 540US are disposed at places facing the device shutter lower side groove portions 512DC. Due thereto, processor shutter upper side groove portions 540UC, that are shorter than the heights of the processor shutter upper side projecting portions 540US, are formed between the processor shutter upper side projecting portions 540US that are adjacent to one another. Further, at the processor shutter 540, plural processor shutter lower side projecting portions 540DS project-out toward a processor money insert/dispensing port frame 553. The processor shutter lower side projecting portions 540DS extend from the front end to the rear end along the front-rear direction at the lower surface of the processor shutter plate portion 540A at places that coincide with the left-right direction positions of the processor shutter upper side projecting portions 540US. The processor shutter lower side projecting portions 540DS are provided at a predetermined interval in the left-right direction.

The device shutter 512 and the processor shutter 540 mesh-together in a non-contact state due to the processor shutter upper side projecting portions 540US entering into the device shutter lower side groove portions 512DC, and the device shutter lower side projecting portions 512DS entering into the processor shutter upper side groove portions 540UC, and a so-called nested structure is formed along the transverse direction.

Moreover, the above embodiments describe cases in which the hand sensor 60 is disposed at the lower side of the processor shutter 40. The present invention is not limited to this, and the optical axis of the hand sensor 60 may be positioned between the device shutter 12 and the processor shutter 40. In short, it suffices for the one hand sensor 60 to be provided either at the lower side of the processor shutter 40, or between the device shutter 12 and the processor shutter 40.

Moreover, the above embodiments describe cases in which the one hand sensor 60 that has the one optical axis is provided. The present invention is not limited to this, and one group of hand sensors 60 that have three optical axes may be provided at positions that are parallel in the left-right direction for example.

Moreover, the first embodiment describes a case in which the front panel 4 is formed so as to be rotatable with respect to the device housing 2 around the front panel supporting point 4A that is provided in a vicinity of the upper end portion of the device housing 2. The present invention is not limited to this, and the front panel may be rotated around a supporting point that is provided at any of various places such as the lower end portion, the right end portion, the left end portion or the like of the front panel 4. In this case as well, it suffices to lay the wiring cable 48 in a vicinity of the axis. Further, the front panel may be opened and closed by any of various operations such as sliding the front panel with respect to the device housing 2, or the like.

Moreover, the above embodiments describe cases in which the bill processor 22 is structured such that the various types of mechanisms that carry out processings relating to bills such as the money insert/dispensing portion 26, the conveying section 28, the discriminating section 30, the temporary holding portion 32, the recycling depositories 34, the reject depository 36, the left-behind depository 38 and the like, are enclosed by the processor housing 24, and are accommodated in the device housing 2. The present invention is not limited to this, and there may be a structure in which the bill processor does not have the processor housing, and units such as the money insert/dispensing portion 26, the conveying section 28, the discriminating section 30, the temporary holding portion 32, the recycling depositories 34, the reject depository 36, the left-behind depository 38 and the like, are accommodated at the device housing 2 interior. In this case, it suffices for the processor shutter to be provided at the money insert/dispensing portion 26.

Moreover, the above embodiments describe cases in which the present invention is applied to the automatic cash transaction device 1 that exchanges cash. The present invention is not limited to this, and the present invention may be applied to various types of devices that process thin, paper-like media such as, for example, gift certificates, cash vouchers, entrance tickets, and the like. Further, the present invention may be applied to a cash processing device that is structured by combining plural types of devices that carry out various types of processing relating to transactions of bills and coins, such as, for example, a bill processor into and from which bills are inserted and dispensed, a sealing/bundling dispensing machine that seals a predetermined number of bills each, and the like.

Moreover, the above-described embodiments describe cases in which the automatic cash transaction device 1 that serves as the media transaction device is structured by the device housing 2, the bill processor 22, the bill accommodating portion 54, the customer interface control section 18, the processor control section 20, and the hand sensor 60 that serves as the foreign object sensor. The present invention is not limited to this, and the media transaction device may be structured by a device housing, a processor housing, a media accommodating portion, a customer interface control section, a processor control section and a foreign object sensor of various structures other than this.

INDUSTRIAL APPLICABILITY

The present invention can be used also in various types of devices that open and close two shutters, and into and from which media are inserted and dispensed.

The disclosure of Japanese Patent Application No. 2014-170529 is, in its entirety, incorporated by reference into the present specification.

All publications, patent applications, and technical standards mentioned in the present specification are incorporated by reference into the present specification to the same extent as if such individual publication, patent application, or technical standard was specifically and individually indicated to be incorporated by reference.

The invention claimed is:

1. A media transaction device, comprising:

a device housing having a front panel;

a display provided at the front panel;

a media processor provided in an interior of the device housing and carrying out a processing of media;

a media accommodating unit provided in an interior of the media processor and accommodating media;

a foreign object sensor that generates an optical axis within the media accommodating unit, the foreign object sensor detecting an absence and presence of a foreign object by whether or not the optical axis is blocked by the foreign object;

a first control unit provided exterior to the media processor and in the interior of the device housing, and controlling at least a display processing of the display; and a second control unit provided in the interior of the media processer and controlling the media processor; wherein:

the front panel includes a first port into and from which media are inserted and dispensed, and a first shutter opening and closing the first port, the first shutter including a plurality of projecting portions and a plurality of groove portions;

the media processor includes a second port and a second shutter, the second port being disposed so as to face the first port, the media being inserted into and dispensed from the second port such that the media are inserted into and dispensed from the first port, and the second shutter opening and closing the second port, the second shutter including a plurality of projecting portions and a plurality of groove portions;

the optical axis of the foreign object sensor is positioned lower than the second shutter;

the second control unit acquires results of the foreign object sensor detecting the absence and presence of the foreign object, and controls opening and closing of the first shutter and the second shutter based on the results of the foreign object sensor, and the first shutter and the second shutter are positionable so that at least one of the projecting portions of the first shutter is nested between adjacent ones of the projecting portions and received within a corresponding groove of the second shutter, and at least one of the projecting portions of the second shutter is nested between adjacent ones of the projecting portions and received within a corresponding groove of the first shutter, to prevent the foreign object from passing therebetween.

2. The media transaction device of claim 1, wherein the media accommodating unit is opened or closed-off with respect to an exterior via the first port and the second port by the opening and closing of the first shutter and the second shutter.

3. The media transaction device of claim 1, wherein:

the front panel rotates, around a front panel support point as a rotation axis, from a position where a portion or the whole of the device housing is covered by the front panel to a position where the front panel is away from the device housing; and the first shutter at the front panel is located at a position away from the second shutter disposed at the media processor in the event that the front panel is away from the device housing.

4. The media transaction device of claim 3, wherein the media processor is provided at a lower side of the device housing, and the front panel supporting point is provided in a vicinity of an upper end at the device housing.

5. The media transaction device of claim 1, further comprising a first motor driving the first shutter, wherein:

the second control unit and the first motor are connected by a first wire, and the first wire is led from the second control unit, is routed near the front panel supporting point, and reaches the first motor.

6. The media transaction device of claim 1, further comprising a second motor driving the second shutter, wherein the second control unit and the second motor are connected by a second wire.

7. The media transaction device of claim 1, wherein the second control unit and the foreign object sensor are connected by a third wire.

8. The media transaction device of claim 1, further comprising a first motor driving the first shutter, wherein:

the second control unit and the first motor are connected by a first wire, the first wire is provided with a connecting member configured by a first member and a second member, the first wire is conductive when the first member and the second member are fit together, and the first wire is insulated when the first member and the second member are apart from one another.

9. The media transaction device of claim 1, further comprising a first motor driving the first shutter, wherein:

the second control unit and the first motor are connected by wireless communication, and the second control unit transmits control signals, that control the first motor, to the first motor by the wireless communication.

10. The media transaction device of claim 1, wherein:

the first shutter and the second shutter face one another without contacting one another.

11. The media transaction device of claim 1, wherein the optical axis of the foreign object sensor is positioned between an upper end and a lower end of the second shutter that is positioned lower than the first shutter.

12. The media transaction device of claim 1, wherein the optical axis of the foreign object sensor is positioned further toward a lower side than a lower end of the second shutter.

13. The media transaction device of claim 1, wherein the foreign object is a hand of a user.

14. A media transaction device, comprising:

a device housing having a front panel;

a media processor provided in an interior of the device housing and carrying out a processing of media;

a media accommodating unit provided in an interior of the media processor and accommodating media; and a foreign object sensor that generates an optical axis within the media accommodating unit, the foreign object sensor detecting an absence and presence of a foreign object by whether or not the optical axis is blocked by the foreign object, wherein:

the front panel includes a first port into and from which media are inserted and dispensed, and a first shutter opening and closing the first port, the first shutter including a plurality of projecting portions and a plurality of groove portions;

the media processor includes a second port and a second shutter, the second port being disposed so as to face the first port, the media being inserted into and dispensed from the second port such that the media are inserted into and dispensed from the first port, and the second shutter opening and closing the second port, the second shutter including a plurality of projecting portions and a plurality of groove portions;

the optical axis of the foreign object sensor is positioned lower than the second shutter;

opening and closing of the first shutter and the second shutter are controlled based on detection results by the foreign object sensor, and the first shutter and the second shutter are positionable so that at least one of the projecting portions of the first shutter is nested between adjacent ones of the projecting portions and received within a corresponding groove of the second shutter, and at least one of the projecting portions of the second shutter is nested between adjacent ones of the projecting portions and received within a corresponding groove of the first shutter, to prevent the foreign object from passing therebetween.

* * * * *